United States Patent [19]

Aoyama et al.

[11] Patent Number: 4,584,974

[45] Date of Patent: Apr. 29, 1986

[54] VALVE OPERATION CHANGING SYSTEM OF INTERNAL COMBUSTION ENGINE

[75] Inventors: Shunichi Aoyama, Yokosuka; Manabu Kato, Tokyo, both of Japan

[73] Assignee: Nissan Motor Co., Ltd., Yokohama, Japan

[21] Appl. No.: 514,687

[22] Filed: Jul. 18, 1983

[30] Foreign Application Priority Data

Jul. 27, 1982 [JP] Japan ..... 57-113690[U]
Dec. 29, 1982 [JP] Japan ..... 57-233593
Jan. 12, 1983 [JP] Japan ..... 58-2326[U]

[51] Int. Cl.[4] ..... F01L 1/34

[52] U.S. Cl. ..... 123/90.16; 123/198 F; 123/90.39

[58] Field of Search ..... 123/90.16, 90.39, 198 F

[56] References Cited

U.S. PATENT DOCUMENTS 4,253,434 3/1981 Takizawa et al. ..... 123/90.16 X
4,278,233 7/1981 Zürner et al. ..... 123/90.16 X
4,354,460 10/1982 Mae et al. ..... 123/90.16

FOREIGN PATENT DOCUMENTS 52-44314 4/1977 Japan ..... 123/90.16
52-124307 9/1977 Japan ..... 123/90.16
54-127012 9/1979 Japan ..... 123/90.15
54-140015 10/1979 Japan ..... 123/90.16
139551 10/1980 Japan ..... 123/90.16

*Primary Examiner*—William R. Cline
*Assistant Examiner*—Peggy A. Neils
*Attorney, Agent, or Firm*—Schwartz, Jeffery, Schwaab, Mack, Blumenthal & Evans

[57] ABSTRACT

A valve operation changing system of an internal combustion engine, comprises a rocker arm (3, 3') to operate an intake or exhaust valve (2, 11), and a control device (19A, 19B, 22, 23, 24, 25, 26) for axially moving the rocker arm so as to selectively cause the rocker arm (3, 3') to engage with first or second cam (12, 13; 45A, 45B) in accordance with an engine operating condition. The control device includes an actuator having first and second hydraulic pressure chambers (**19A, 19B; 50*a*, 50*b*) whose pressures move the rocker arm (3, 3') to engage with the first and second cams (12, 13; 45A, 45B), respectively. A flow direction changing valve (23) is provided to selectively supply the first or second hydraulic pressure chambers (19A, 19B; 50*a*, 50*b*) with oil from an oil pressure source (21), in accordance with the engine operating condition. A stopper device (26) is provided to restrict the movement of the rocker arm (3, 3'). Additionally, a timing lifter (25) is provided to release the rocker arm (3, 3') from the restriction by the stopper device in timed relation to the rotation of the first and second cams (12, 13; 45A, 45B), thereby accomplishing the axial movement of the rocker arm (3, 3'**) at a predetermined suitable timing and at a higher speed.

33 Claims, 28 Drawing Figures

VALVE OPERATION CHANGING SYSTEM OF INTERNAL COMBUSTION ENGINE

BACKGROUND OF THE INVENTION

1. Field of the Invention

This invention relates to an improvement in a valve operation changing system for changing the valve timings of intake or exhaust valve of an internal combustion engine in accordance with engine operating conditions, and more particularly to a hydraulic system for controlling the transfer of a rocker arm from a first position to a second position, and vice versa at a higher speed and at a predetermined suitable timing.

2. Description of the Prior Art

Valve operation changing systems have been applied to various uses in the field of internal combustion engines. For example, the valve operation changing system is used in a so-called dual-mode engine which is so arranged that the valve timing of intake and exhaust valve is changed at a light load engine operating range so as to deactivate some cylinders, thereby carrying out a part-load engine operation.

In general, a gasoline engine of the type wherein charge is previously prepared by mixing air and fuel has a tendency that good fuel economy is obtained at a high engine load operating range. In this regard, in the dual-mode engine, the intake and exhaust valves of some cylinders are kept fully closed to interrupt the supply of air and fuel thereinto thereby to deactivate the cylinders. This relatively increases engine load applied to the remaining cylinders, improving combustion and reducing pumping loss. This effectively improves fuel economy of the engine at the light load engine operating range.

The valve timing changing of the intake and exhaust valves of the dual-mode engine is usually carried out by transferring rocker arms from a first cam for cylinder activation or working onto a second cam for cylinder deactivation or rest in accordance with the engine operating conditions. The first and second cams are formed on a single camshaft and located side by side.

Since the transferring of the rocker arms are usually carried out by the biasing force of springs, it is difficult to obtain a sufficient moving speed of the rocker arms, thereby rendering difficult the valve timing changing during a high engine speed engine operation. Besides, there is a fear that the rocker arms and/or cams are damaged due to the fact that valve lift is initiated by the cam at a timing at which the movement of the rocker arm has not yet been terminated. This impairs the reliability and durability of the conventional valve operation changing system.

SUMMARY OF THE INVENTION

A valve operation changing system according to the present invention comprises first and second cams formed on a camshaft and different in cam profile from each other. A rocker arm is mounted on a rocker shaft and swingable around the rocker shaft upon contact with the first and second cams. The rocker arm is also movable in the axial direction of the rocker shaft so as to contact with the first cam when the rocker arm is put in a first position while with the second cam when the rocker arm is put in a second position. Additionally, a control device is provided to selectively put the rocker arm in one of the first and second positions in accordance with an engine operating condition.

The control device includes an oil pressure source for supplying pressurized hydraulic oil. A flow direction changing valve is fluidly connected to the oil pressure source and arranged to selectively take one of its first and second states. First and second hydraulic pressure chambers are defined in connection with the rocker arm and fluidly connectable with the oil pressure source through the flow direction changing valve. The first hydraulic pressure chamber is suppliable with the oil from the oil pressure source to put the rocker arm into the first position when the flow direction changing valve is in the first state, while the second hydraulic pressure chamber is suppliable with the oil from the oil pressure source to put the rocker arm into the second position when the flow direction changing valve is in the second state. A sensor device is provided to selectively put the flow direction changing valve into one of the first and second states in accordance with the engine operating condition. A stopper device is provided to restrict the operation of the rocker arm. Additionally, a releasing device is provided to release the rocker arm from the restriction action of the stopper device in timed relation to the rotation of the first and second cams, thereby carrying out the movement of the rocker arm between the first and second positions in timed relation to the rotation of the first and second cams.

Accordingly, the transfer of the rocker arm between the first and second cams is accomplished by the driving force due to the pressurized oil from the accumulator, providing a higher rocker arm carrying speed corresponding to that of a large capacity oil pump. Besides, rocker arm transferring timing is precisely regulated so that the movement of the rocker arm is initiated at an optimum timing, thereby making possible to complete the transfer of the rocker arm before a valve lift in the succeeding step takes place under the action of the cam. This effectively prevents the rocker arm/or the cam from damage, thereby attaining the reliability and durability of the valve operation changing system.

BRIEF DESCRIPTION OF THE DRAWINGS

The features and advantages of the valve operating changing system according to the present invention will be more clearly appreciated from the following description taken in conjunction with the accompanying drawings in which like reference numerals designate like parts and elements throughout all the embodiments of the present invention, and in which.

DETAILED DESCRIPTION OF THE INVENTION

To facilitate understanding the present invention, a brief reference will be made to a so-called dual-mode internal combustion engine provided with a conventional valve operation changing system, with reference to FIGS. 1 to 6. In the case where the dual-mode engine is of the four-cylinder type, the rest or deactivation of two cylinders causes the combustion interval to be prolonged as 360 degrees in crank angle, thus increasing torque variation. However, it has already been proved by the present applicants, that such torque variation can be suppressed by supplementing fresh air into the rest or deactivated cylinders to regulate the pressure therein.

Figure 1:
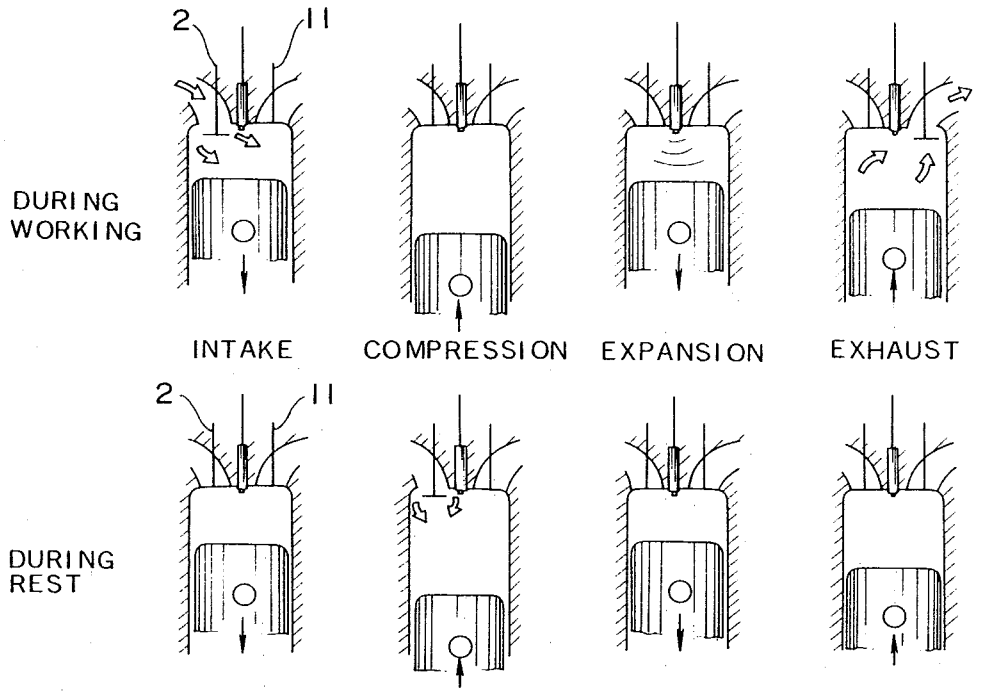
FIG. 1 is a schematic illustration showing the valve operation of a dual-mode internal combustion engine.
Figure 2A:
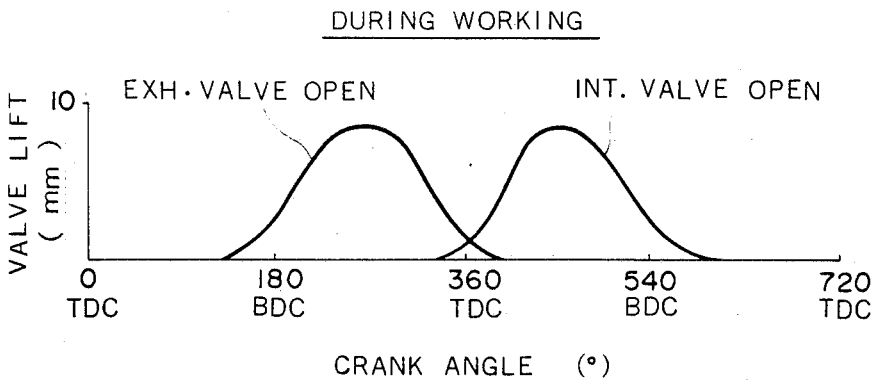
FIG. 2A is a graphical representation showing the valve timings of intake and exhaust valves during cylinder working of activation or working.
Figure 2B:
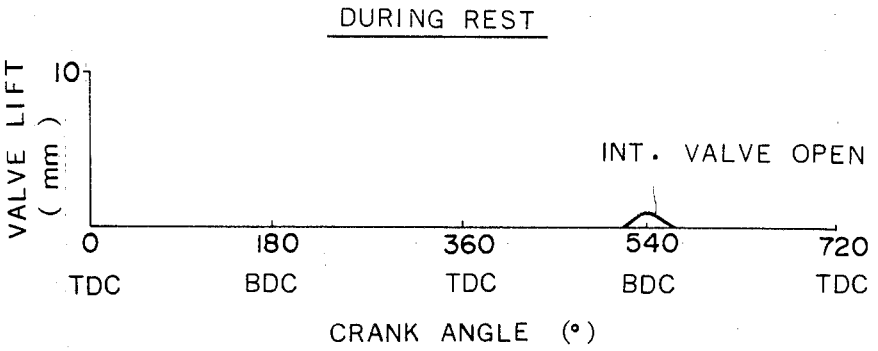
FIG. 2B is a graphical representation showing the valve timing of the intake valve during cylinder rest or deactivation.
Figure 3:
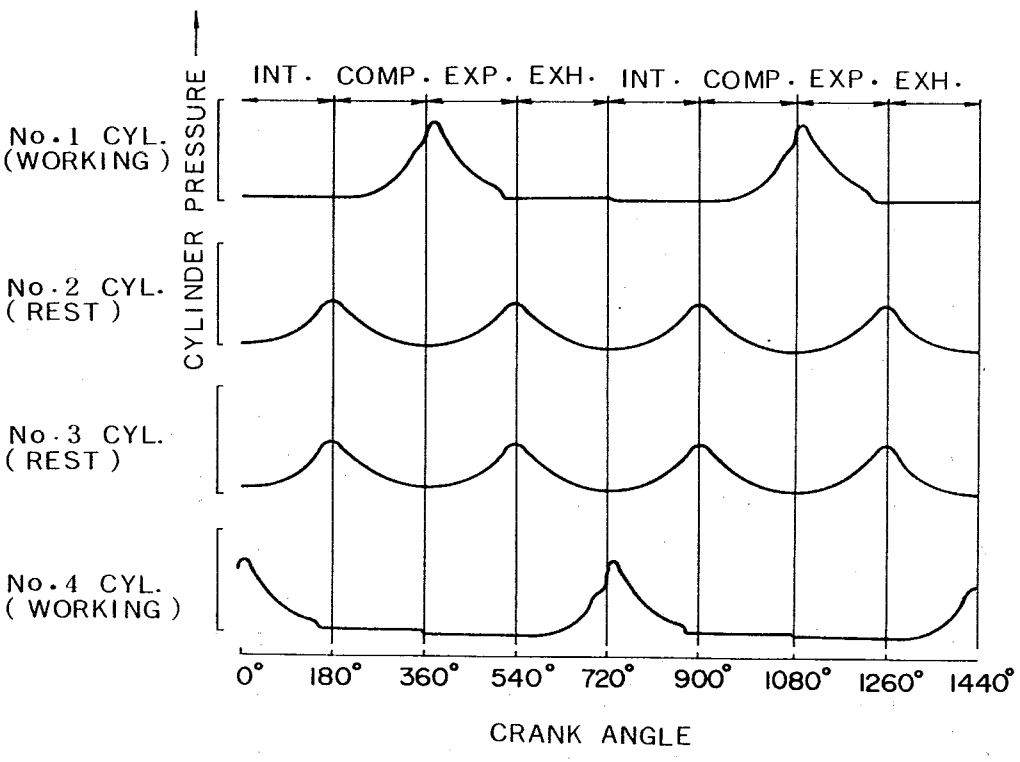
FIG. 3 is a graphical representation showing the variation of cylinder pressure of each cylinder.

Such torque variation suppression will be briefly discussed particularly with reference to FIGS. 1 to 3. With respect to the two cylinders each of which is changeable from its working or activated state to its rest or deactivated state, and vice versa. As shown in FIG. 1, during cylinder working or activation, the cylinder has a valve opening characteristics of intake and exhaust valves, same as in a usual four-stroke cycle engine, in which an intake valve 2 opens at intake stroke, and closes at compression stroke, and an exhaust valve 11 opens from the terminal stage of expansion stroke throughout exhaust stroke; however, during the cylinder rest or deactivation, the exhaust valve 11 always closes and the intake valve 2 slightly opens in the vicinity of bottom dead center (in intake and/or expansion stroke) of piston, thus providing a valve lift characteristics as shown in FIGS. 2A and 2B.

According to this valve lift characteristics, at the time point at which compression is initiated, the cylinder pressure (pressure within the cylinder) of the rest or deactivated cylinder becomes equal to intake manifold vacuum; and thereafter simple compression and expansion is repeated in the cylinder under the ascent and descent movements of the piston, thus providing a cylinder pressure variation characteristics as shown in FIG. 3, for the four cylinders (cylinder Nos. 1 to 4) during an engine operation mode in which the Nos. 2 and 3 cylinders are at rest or deactivated. Although the peak value of pressure variation in the rest cylinders (cylinder Nos. 2 and 3) is about half that in the working cylinders (cylinder Nos. 1 and 4), such respective torque variations of the two rest cylinders are seemingly combined to give two times effect because the respective pressure variations of the two rest cylinders are made in synchronism with each other, so that the pressure variation peak level of the two rest cylinders generally corresponds to that of the working cylinder at a certain crank angle. Thus, as a total torque variation of the engine, one similar to in the peak value of combustion pressure can be obtained at the intervals of 180 degrees in crank angle, thereby greatly improving the smoothness in engine revolution.

In this regard, in order to change the operation modes of the engine, it is effective to change the valve operation of the intake and exhaust valves by selectively using one of two cams to which the valves are mechanically connected. An example of the thus arranged conventional valve operation changing system will now be discussed in connection with the dual-mode engine.

Figure 4:
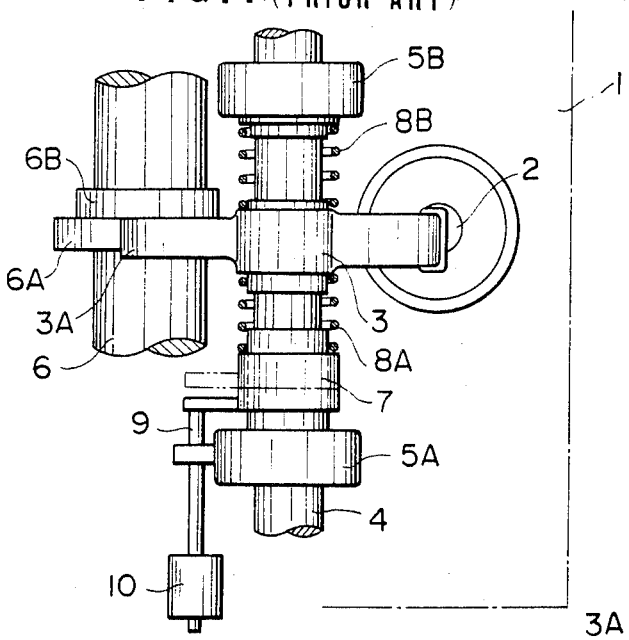
FIG.4 (PRIOR ART)
FIG. 4 is a plan view of a conventional valve operation changing system.
Figure 5:
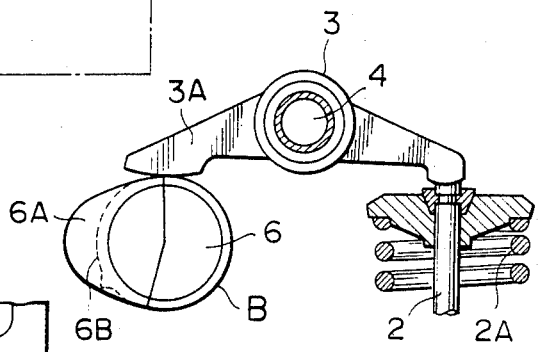
FIG.5 (PRIOR ART)
FIG. 5 is a front elevation of the system of FIG. 1.
Figure 6:
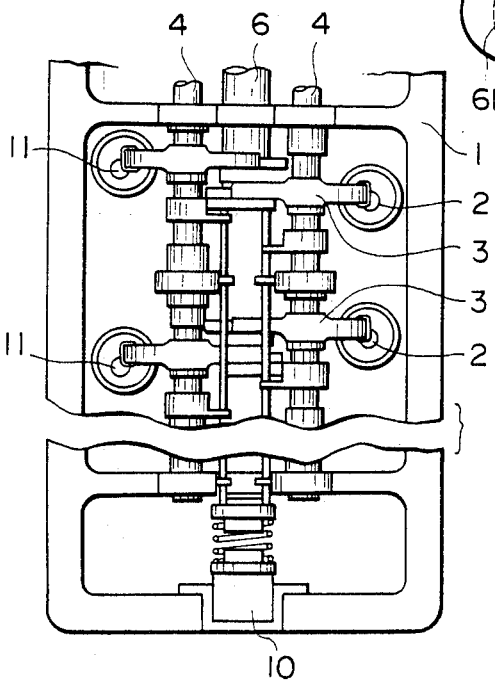
FIG.6 (PRIOR ART)
FIG. 6 is a plan view of an essential part of a dual-mode engine equipped with the conventional valve operation changing system of FIG. 4.

As depicted in FIGS. 4 to 6, a cylinder head 1 is provided with an intake valve 2 in cooperation with a cylinder (not shown). A rocker arm 3 is rotatably mounted on a rocker shaft 4. The rocker shaft 4 is rotatably supported through brackets 5A, 5B by the cylinder head 1. The reference numeral 6 denotes a camshaft.

The camshaft 6 is formed with first and second cams 6A, 6B located side by side. The first cam 6A has a cam profile for opening the intake valve 2 through the rocker arm 3 in a manner indicated in FIG. 2A at the intake stroke during the working or activation of the cylinder, under the cooperation of a valve spring 2A shown in FIG. 5. The second cam 6B has a cam profile for opening the intake valve 2 through the rocker arm 3 only in a manner indicated in FIG. 2B at the terminal stage (at the piston location in the vicinity of bottom dead center) of intake stroke during the rest or deactivation of the cylinder. In this case, the cylinder is arranged to put into the rest or deactivated condition when the engine is operated at a light load engine operating range. The rocker arm 3 is swingable relative to the rocker shaft 4, and elastically supported between the brackets 5A, 5B under the action of first and second springs 8A, 8B so as to be movable in the axial direction of the rocker shaft 4, i.e., in the upward and downward direction in the drawing. More specifically, a changing ring 7 for changing the location of the rocker arm 3 is slidably mounted on the rocker shaft 4 and arranged to be slidable in the axial direction of the rocker shaft 4 between the rocker arm 3 and the bracket 5A. Accordingly, locating the changing ring 7 is achieved under the balance of tension between the first spring 8A and the second spring 8B. The first spring 8A is located between the changing ring 7 and the rocker arm 3, while the second spring 8B is located between the bracket 5B and the rocker arm 3.

The changing ring 7 is actuated through a rod 9 by an actuator 10 which includes a solenoid or hydraulic cylinder. The actuator 10 in this case is adapted to move the changing ring 7 into a location indicated in phantom in FIG. 4 in order to cause the rocker arm 3 to contact with the second cam 6B. Thus, during the working of the cylinder, the changing ring 7 is arranged to locate the rocker arm 3 on the first cam 6A so as to open or close the intake valve 2 in accordance with the cam profile of the first cam 6A as shown in FIG. 2A. From this state, when the changing ring 7 is moved toward the bracket 5B under the driving force of the actuator 10, the springs 8A, 8B are compressed to push the rocker arm 3 so that the rocker arm 3 moves onto the second cam 6B during the time period at which a follower section 3A of the rocker arm 3 resides in the base circle area B of the cam profile of the cam 6A. In this state, the intake valve 2 opens a slight time period at the terminal stage (at the piston location of bottom dead center) of intake stroke in accordance with the cam profile of the second cam 6B as shown in FIG. 2B.

A similar valve operation changing system is provided also for an exhaust valve 11, so that the exhaust valve 11 opens at exhaust stroke during the working of the cylinder in a manner indicated in FIG. 2A, whereas closes during the rest of the cylinder.

Thus, when the actuator 10 is operated at the light load engine operating range, the intake and exhaust actions of cylinders at rest are regulated, thereby preventing the cylinders at rest from being supplied with air-fuel mixture. Accordingly, combustion does not take place in the cylinders at rest, and simultaneously the air-fuel mixture not supplied to the cylinders is inducted into the working cylinders, thus relatively increasing the load applied to the working cylinders. As a result, good fuel economy characteristics can totally be obtained preventing a decrease in engine power output. It will be understood that the reason why the intake valve 2 of the cylinder at rest is slightly opened as shown in FIG. 2B is that an increase in difference between the torques generated at the rest cylinders and the working cylinders is prevented by supplying gas into the rest cylinders thereby to increase compression work in the same cylinders.

However, the following drawbacks are encountered with the above-discussed conventional valve operation changing system:

In connection with the fact that the movement of the rocker arm is made by the biasing force of the springs, it is difficult to obtain a sufficient spring biasing force, for example, for the reason of a restricted space for installation. This unavoidably reduces the moving speed of the rocker arms, thereby rendering difficult the valve operation changing during a high engine speed operation. Besides, the actuator is required to be considerably large-sized in order to function as corresponding to the spring. Furthermore, it will be caused at certain actuator operation timing, that the rocker arm follower section and/or the cam is damaged due to the fact that the valve lift or the rocker arm swingable movement is initiated by the cam at a timing at which the movement of the rocker arm has not yet completed, excessively increasing the pressure applied per unit area at the contact faces of the rocker arm follower section and the cams. This impairs the reliability and durability of the conventional valve operation changing system.

Figure 7:
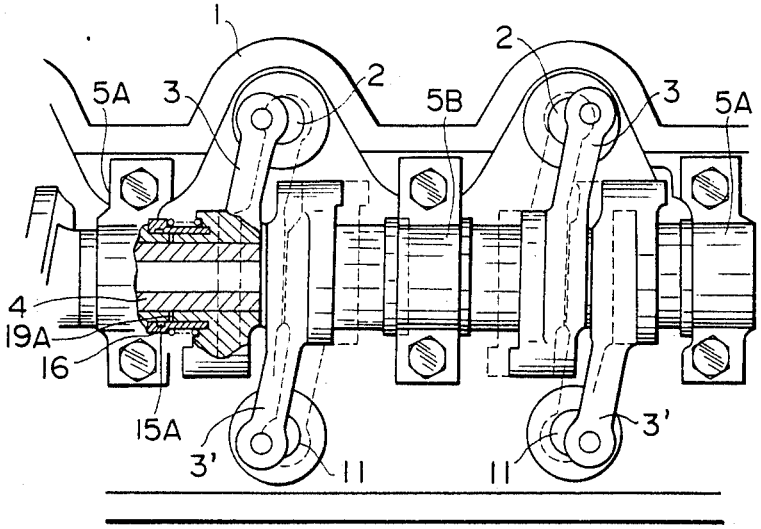
FIG. 7 is a plan view, partly in section, of an essential part of a first embodiment of the valve operation changing system in accordance with the present invention, mounted in a dual-mode engine at its upper part.
Figure 8:
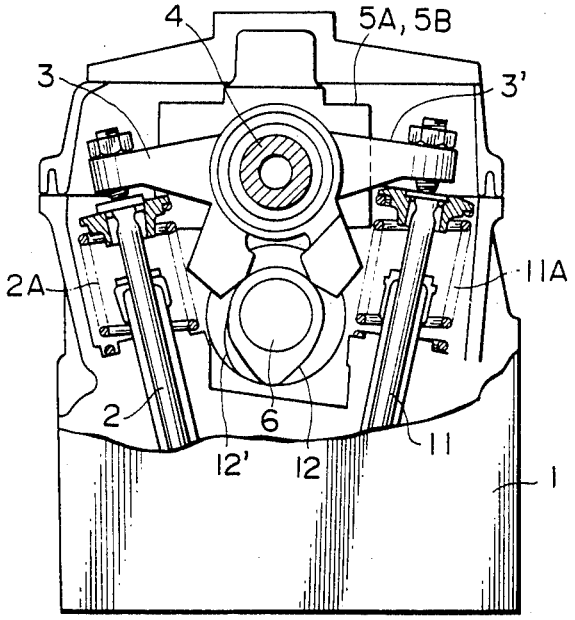
FIG. 8 is a front elevation, partly in section, of the upper part of the engine, showing the front elevation of the system of FIG. 7.
Figure 9:
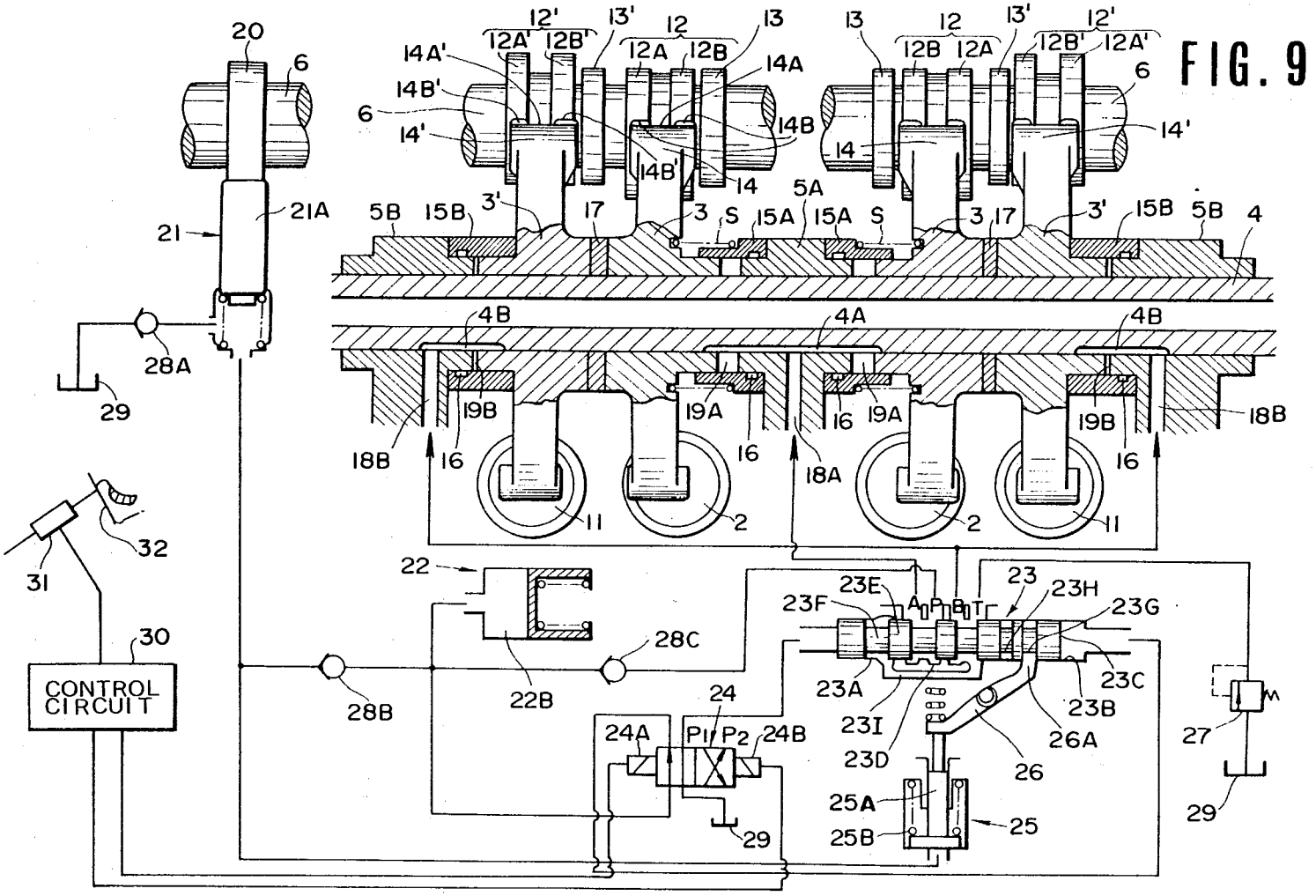
FIG. 9 is a diagram illustrating in detail the system of FIG. 8.

In view of the above description of the conventional valve operation changing system, reference is now made to FIGS. 7 to 9 wherein a first embodiment of a valve operation changing system of an internal combustion engine, according to the present invention is illustrated. The valve operation changing system is used in this case for an in-line four-cylinder internal combustion engine of the so-called dual-mode type wherein two cylinders (cylinder Nos. 2 and 3) are capable of being deactivated or at rest (dead). In FIGS. 7 to 9, the same reference numerals as in FIGS. 4 to 6 designate the same parts and elements for the purpose of simplicity of illustration.

As shown, a cylinder head 1 is provided with an intake valve 2 in cooperation with a cylinder (not shown). A rocker arm 3 is rotatably mounted on a rocker shaft 4. The rocker shaft 4 is rotatably supported through brackets 5A, 5B by the cylinder head 1. A camshaft 6 is also rotatably supported by the cylinder head 1.

The camshaft 6 is formed with cams 12, 13 for the intake valve 2, and cams 12', 13' for an exhaust valve 11. These cams are disposed adjacent to each other, in which the cam 12 and the cam 13 are located side by side. The intake and exhaust valves 2, 11 are operated to open and close in a manner as shown in FIG. 2A during the activation or working of the cylinders, through the rocker arms 3 and a rocker arm 3' under the cooperation of the valve spring 2A and a valve spring 11A. During the deactivation or rest, the intake valve 2 is operated to open and close in a manner as shown in FIG. 2B.

The rocker arms 3, 3' are not only swingable relative to the rocker shaft 4 but also slidable in the axial direction of the rocker shaft 4 between the brackets 5A, 5B. Accordingly, when a pressurized oil is introduced into a hydraulic pressure chamber 19A defined by the rocker shaft 4, the bracket 5A, a collar 15A and the rocker arm 3, the rocker arms 3, 3' move from a state (indicated by solid lines) to another state (indicated by broken lines) in FIG. 7, thereby changing the valve timing of the intake and exhaust valves 2, 11.

In FIG. 9, the valve operation changing system is illustrated in great detail, in which the camshaft 6 is shown to be located above the rocker shaft 4 and the intake and exhaust valves 2, 11 are shown to be located below the rocker shaft 4 in the drawing so that the camshaft 6 and the intake and exhaust valves 2, 11 are shown to be positioned approximately symmetrical with each other for reasons of convenience. Accordingly, the arrangement of them is slightly deformed relative to an actual model of the valve operation changing system in accordance with the present invention.

As shown, the cam 12 for the intake valve 2 and for cylinder activation is divided into two equal parts in a plane to which the camshaft axis is perpendicular, to form the narrower cams 12A, 12B which are the same in cam profile or contour with each other. The cam profile of the cam 13 is different from that of the narrower cams 12A, 12B. In this case, the cam profile of the cams 12A, 12B corresponds to that of the cam 6A in FIG. 4, so that the intake valve 2 operates in the manner as shown in FIG. 2A, in accordance with the cam profile of the cams 12A, 12B. The cam profile of the cam 13 corresponds to that of the cam 6B in FIG. 4, so that the intake valve 2 operates in the manner as shown in FIG. 2B, in accordance with the cam profile of the cam 13. The cam 13 is formed equal in width to the narrower cam 12A, 12B. These cams are aligned side by side in the order of the narrower cam 12A, the narrower cam 12B, and the cam 13, leaving a clearance (no numeral) between the narrower cams 12A and 12B which clearance is approximately the same in width as the cams 12A and 12B. In this connection, the follower section 14 of the rocker arm 3 is formed with two contact portions 14B, 14B which are spaced from each other and respectively contactable with the cam face of the cam 12A and the cam face of the cam 12B. It will be understood that when the rocker arm 3 is moved toward the side of the cam 13 nearly by a distance of the width of the cam 12A, 12B, 13 in the axial direction of the rocker shaft 4 so that one of the contact portions 14B, 14B is brought into contact with the cam 13, the cam 12B becomes located between the two contact portions 14B, 14B. In this regard, a cutout portion 14A is formed between the two contact portions 14B, 14B in order that the cam 12B does not obstruct an effective contact between the cam 13 and one of the contact portions 14B. As shown, the cam 12' for the exhaust valve 11 is likewise formed to have the narrower cams 12A', 12B' which are spaced from each other. The narrower cams 12A', 12B' have a cam profile for providing the exhaust valve operation manner as shown in FIG. 2A. The cam 13' has such a cam profile that the exhaust valve remains closed as shown in FIG. 2B. The follower section 14' of a rocker arm 3' for the exhaust valve 11 is likewise formed to have two contact portions 14B', 14B' leaving a cutout portion 14A' therebetween. It will be appreciated that the cams 12A, 12B, 12A' and 12B' and the rocker arm follower sections 14, 14' are constructed and arranged such that the amount of movement of the rocker arms 3, 3' becomes nearly half that in the conventional valve operation changing system as shown in FIGS. 4 to 6.

As shown in FIG. 9, the collar 15A is slidably mounted on the rocker shaft 4 and located between the rocker arm 3 and the bracket 5A, while a collar 15B is likewise mounted on the rocker shaft 4 and located between the rocker arm 3' and the bracket 5B. Additionally, a spring S is interposed between the collar 15A and the rocker arm 3 and causes the engine to operate in accordance with the cams 12, 12' at an engine starting in which hydraulic oil pressure has not yet sufficiently been raised. The spring S urges the rocker arms 3, 3' toward the side of the cams 12, 12' for cylinder activation. The reference numeral 17 denotes a spacer ring.

The hydraulic pressure chamber 19A is defined by the bracket 5A, the collar 15A, the rocker shaft 4 and the rocker arm 3 as mentioned above, while a hydraulic pressure chamber 19B is defined by the bracket 5B, the collar 15B, the rocker shaft 4 and the rocker arm 3'. Pressure passages 18A, 4A communicated with the pressure chamber 19A are formed in the bracket 5A and the rocker shaft 4, respectively. Pressure passages 18B, 4B communicated with the pressure chamber 19B are formed in the bracket 5B and the rocker shaft 4, respectively. When these pressure chambers 19A, 19B are supplied with pressurized oil through a flow direction changing valve 23, the rocker arms 3, 3' are moved in the axial direction of the rocker shaft 4. The reference numeral 16 designates an oil seal used for the collars 15A, 15B.

An oil pump 21 functions to pressurize hydraulic oil from an oil tank 29, and so arranged that the reciprocal motion of a piston 21A of the oil pump is made by a cam 20 formed on the camshaft 6, so that the oil pump 21 discharges pressurized oil. An accumulator 22 stores or accumulates the oil from the oil pump 21 and supplies pressurized oil into the hydraulic chambers 19A, 19B through the flow direction changing valve 23, and into an pilot valve 24. Now, it seems that a regard must be paid to the time duration at which the pressure within the pressure chamber 22B of the accumulator 22 again reaches a predetermined level with the oil from the oil pump 21 after the stored oil within the pressure chamber 22B is discharged out. However, the time duration to obtain the predetermined pressure is, for example, about 0.5 second even during engine idling (at about 600 rpm) in case where the discharge amount of the accumulator 22 is set to 5 cc and the discharge amount of the oil pump 21 is set to 1 cc per each engine revolution. Accordingly, it is justifiable in practice to consider that the accumulator 22 is always filled with the hydraulic oil having a pressure higher than the predetermined level.

The flow direction changing valve 23 is of the reciprocally movable four-port spool type and formed at its body section with a spool hole 23B of the right cylindrical shape. A spool 23C is adapted to be disposed and slidable within the spool hole 23B. Additionally, the body section of the valve 23 is provided with four annular grooves 23D which respectively communicate with a cylinder port A, a pump port P, a cylinder port B, and a tank port T as shown. The cylinder port A communicates through the oil pressure passages 18A, 4A with the hydraulic pressure chamber 19A. The cylinder port B communicates through the oil pressure passages 18B, 4B with the hydraulic pressure chamber 19B. The pump port P communicates with the pressure chamber 22B of the accumulator 22. The tank port T communicates with the oil tank 29.

The spool 23C includes spool lands 23E in slidable contact with the inner surface of the spool hole 23B, and spool rod sections 23F. One end section of the spool 23C is formed with grooves 23G, 23H with which the pawl 26A of a stopper 26 for preventing the movement of the spool 23C is engageable. Accordingly, when the spool 23C is moved under the action of a pilot pressure from the pilot valve 24, oil passages formed by the cooperation of the annular grooves 23D and the spool rod sections 23F are changed, so that the supply of oil pressure into the hydraulic pressure chambers 19A, 19B is changed.

For example, when the pilot oil pressure acts on the right side of the spool 23C to move the spool 23C to an extreme left-hand position (in the drawing) at which the pawl 26A of the stopper 26 is engaged with the groove 23G, the pressurized oil from the accumulator 22 is supplied to the hydraulic pressure chamber 19A through the pump port P, the oil passage within the spool hole 23B, and the cylinder port A. Simultaneously, the oil in the hydraulic pressure chamber 19B is restored to the oil tank 29 through the cylinder port B, the oil passage within the spool hole 23B, and the tank port T. Conversely, when the spool 23C is in an extreme right-hand position (in the drawing) at which the pawl 26A of the stopper 26 is engaged with the groove 23H, the pressurized oil from the accumulator 22 is supplied to the hydraulic pressure chamber 19B through the pump port P, the oil passage within the spool hole 23B, and the cylinder port B. Simultaneously, the oil within the pressure chamber 19A is restored to the oil tank 29 through the cylinder port A, an oil passage within the spool hole 23B, and the tank port T.

A timing lifter 25 is provided to release the stopper 26 from the grooves 23G, 23H in timed relation to the rotation of the two cams 12, 13 for the intake valve 2 (or of the two cams 12', 13' for the exhaust valve 11). The timing lifter 25 is directly supplied (not through a check valve) with the pressurized oil whose pressure is developed by the reciprocal motion of the piston 21A which is in timed relation to the cam 20 for driving the oil pump 21. As a result, the piston 25A of the timing lifter 25 makes its simple reciprocal motion in timed relation to the cam 20. When the piston 25A is lifted (moved upwardly) against the bias of a spring 25B, the engagement of the stopper pawl 26A with the groove 23G is released. It is to be noted that the biasing force of the spring 25B for urging the piston 25A downward is so set that the upward movement of the piston 25A is made under a pressure higher than the predetermined level for the accumulator 22. Furthermore, the cam 20 for the oil pump driving is formed such that the stopper releasing timing of this lifter 25 corresponds to the time point at which the intake valve 2 of either one cylinder (the No. 2 cylinder in this case) of the cylinders (the Nos. 2 and 3 cylinders) which are capable of being deactivated is closed.

The pilot valve 24 for controlling the flow direction changing valve 23 is arranged to be put into either one of positions P1 and P2 under the action of solenoid 24A, 24B which are capable of being energized by electric signals from a control circuit 30. When the solenoid 24A is energized to put the pilot valve 24 into the P1 position, the pressurized oil from the accumulator 22 is allowed to be supplied to the right side of the flow direction changing valve 23 so as to urge the spool 23C to the extreme left-hand position, thereby restoring the oil at the left side of the valve 23 into the oil tank 29. On the contrary, when the solenoid 24B is energized to move the pilot valve 24 into the P2 position, the pressurized oil from the accumulator 22 is allowed to be supplied to the left side of the flow direction changing valve 23 so as to urge the spool 23C into the extreme right-hand position, thereby restoring the oil at the right side of the valve 23 into the oil tank 29.

The control circuit 30 is adapted to receive an electric signal from an engine load sensor 31 for sensing engine load condition which sensor is in operative connection with an acceleration pedal 32, and to energize the solenoid 24B of the pilot valve 24 to put the pilot valve 24 into the P2 position when the engine is operated at a predetermined light load operating range. It will be understood that the reference numerals 28A, 28B and 28C denote check valves, respectively, and the reference numeral 27 a relief valve.

The manner of operation of the thus arranged valve operation changing system will now be discussed.

During the engine operation in which all the cylinders are under the working condition, the intake and exhaust valves 2, 11 open and close in the manner as shown in FIG. 2A in accordance with the cams 12, 12'. Simultaneously, the reciprocal movement of the oil pump piston 21A is made in accordance with the cam 20 for oil pump driving, thus supplying under pressure the hydraulic oil from the oil tank 29 to the accumulator pressure chamber 22B in which the oil pressure is raised to the predetermined level. The oil having the thus raised pressure reaches both the pump port P of the direction changing valve 23 and the pilot valve 24.

In this state, since the pilot valve 24 is in the P1 position, the pilot oil pressure from the pilot valve 24 is applied to the right side of the flow direction changing valve so as to urge the spool 23C to the extreme left-hand position, so that the stopper pawl 26A engages with the groove 23G as shown in FIG. 9. In this state, the oil reached to the pump port P is supplied to the hydraulic pressure chamber 19A through the oil passage within the spool hole 23B, the cylinder port A, and the oil pressure passages 18A, 4A, so that the rocker arms 3, 3' are urged to be located on the cams 12, 12' for cylinder working. At this time, the hydraulic pressure chamber 19B communicates with the oil tank 29 through the oil pressure passages 4B, 18B, the cylinder port B, the oil passage within the spool hole 23B, and the tank port T.

When the control circuit 30 detects that the engine is operated at the predetermined light load operating range, in accordance with the signal from the load sensor 31 in operative connection with the acceleration pedal 32, the solenoid 24B of the pilot valve 24 is energized to change the pilot valve 24 from the P1 position to the P2 position. Accordingly, the pilot oil pressure from the pilot valve 24 acts on the left side of the flow direction changing valve 23 to urge the spool 23C rightward. However, at this moment, the movement of the spool 23C is restricted by the stopper pawl 26A, so that the spool 23C remains at an urged condition.

Under this state, when the pressure within the accumulator 22 is above the predetermined level, and the engagement of the stopper pawl 26A with the groove 23G is released at the closing timing of the intake valve 2 of the No. 2 cylinder upon the upward movement of the timing lifter piston 25A which makes its reciprocal movement in timed relation to the rotation of 12A, 12B (or 12A', 12B'), the spool 23C moves rightward to the extreme right-hand position. Thereafter, the pawl 26A of the stopper 26 engages with the groove 23H under the downward movement of the piston 25A, thereby preventing the movement of the spool 23C.

It will be appreciated that such movement of the spool 23C makes a change in pressurized oil supply direction, so that the pressurized oil from the accumulator 22 is supplied from the pump port P to the hydraulic pressure chamber 19B via an oil passage within the spool hole 23B, the cylinder port B, and the oil pressure passages 18B, 4B. Simultaneously, the hydraulic pressure chamber 19A communicates with the oil tank 29 through the oil pressure passages 4A, 18A, the cylinder port A, the oil passage 23I, and the tank port T. The oil supplied to the hydraulic pressure chamber 19B causes the rocker arms 3, 3' to move onto the cams 13, 13' for the cylinder deactivation, against the bias of the spring S.

Figures 10A, 10B, 10C:
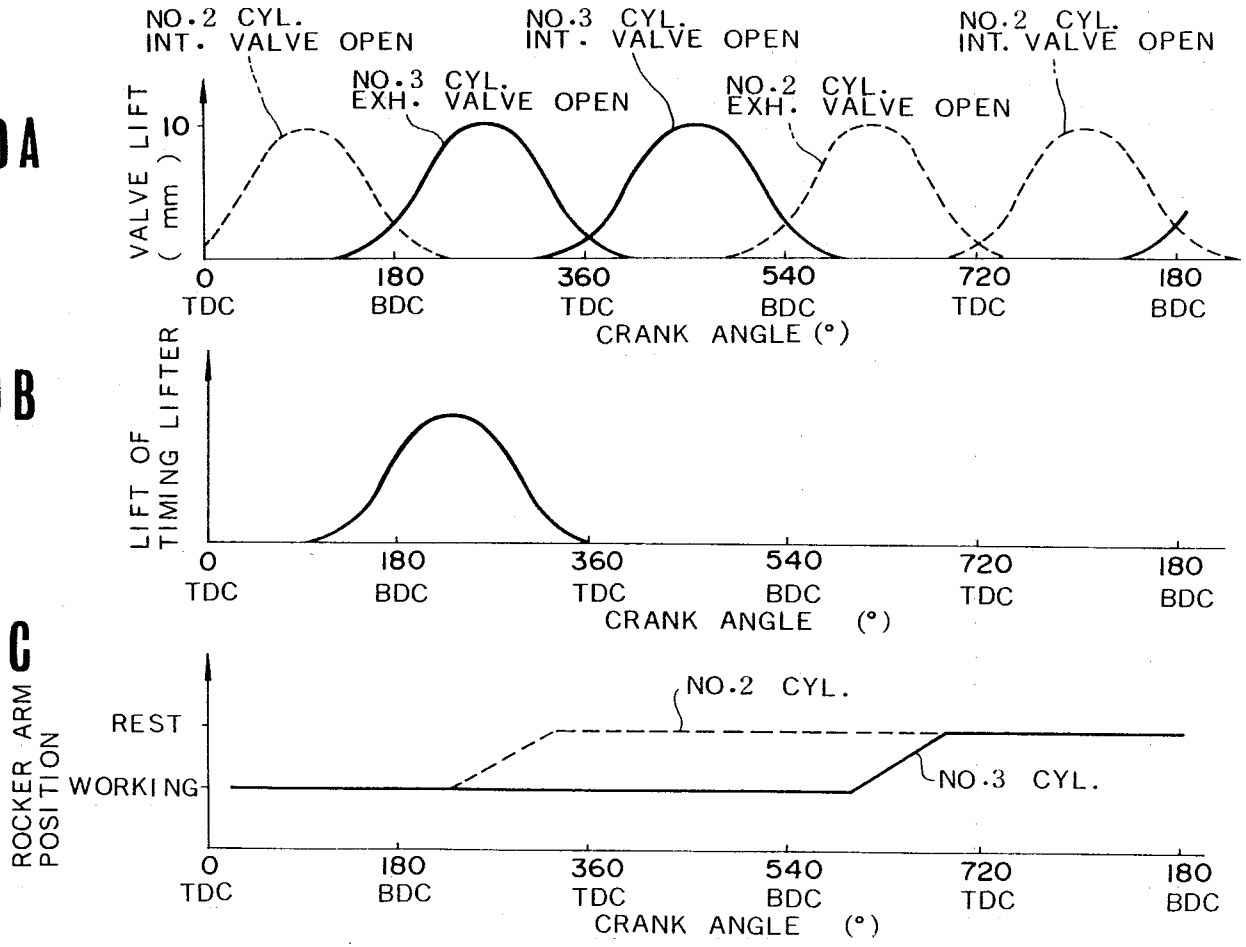
FIG. 10A is a graphical representation showing the valve timing of intake and exhaust valves of Nos. 2 and 3 cylinders during cylinder activation.
FIG. 10B is a graphical representation showing the lift of a timing lifter in relation to the valve timing of FIG. 10A.
FIG. 10C is a graphical representation showing the position of a rocker arm in relation to the valve timing of FIG. 10A.

To be concrete, the lift of the intake and exhaust valves of the cylinders (the Nos. 2 and 3 cylinders) capable of being deactivated takes place as shown in FIG. 10A, in which the timing lifter 25 makes its lift as shown in FIG. 10B so that the timing at which the engagement of the stopper 26 with the spool 23C is released by the lifter 25 corresponds to the closing time point of the intake valve 2 of the No. 2 cylinder, and therefore the intake and exhaust valves 2, 11 of the No. 2 cylinder are maintained at the fully closed state from the time point of the closing timing of the intake valve 2 until the time point at which the exhaust valve of the No. 2 cylinder begins to open. It will be understood that, at this time duration, the follower sections 14, 14' of the rocker arms 3, 3' for the No. 2 cylinder resides on the base circle area B of the cams 12, 12' for cylinder working. Consequently, the rocker arms 3, 3' are smoothly moved from the position of cylinder activation or working to the position of cylinder deactivation or rest as indicated by a broken line in FIG. 10C since the time point at which the intake valve 2 of the No. 2 cylinder is closed, under the driving force of the pressurized oil from the accumulator 22.

At this time point, the intake and exhaust valves 2, 11 of the No. 3 cylinder is making its lift under the action of the cams 12, 12' for cylinder working, and accordingly the rocker arms 3, 3' for the No. 3 cylinder has not yet been moved and stand ready so as to move to the position of cylinder deactivation or rest as indicated by a solid line in FIG. 10C upon closing of the intake valve 2 of the No. 3 cylinder.

After the rocker arms 3, 3' of the Nos. 2 and 3 cylinders are moved to the position of cylinder rest, the intake valves 2 operate to open a slight time period at intake stroke of the piston (in the vicinity of bottom dead center) in accordance with the cam 13 for cylinder deactivation or rest, while the exhaust valve 11 is maintained fully closed in accordance with the cam 13' for cylinder deactivation or rest (See FIG. 2B), thus achieving so-called partial-cylinder operation in which some of all the cylinders are maintained at the deactivated or rest state.

With the thus arranged valve operation changing system, the movement amount or distance of the rocker arms 3, 3' becomes approximately half that in the conventional corresponding system as shown in FIGS. 4 to 6. Additionally, the movement of the rocker arms 3, 3' is smoothly carried out by virtue of employing hydraulic oil pressure which can provide a sufficient moving speed of the rocker arms 3, 3' even during a high engine speed driving. Furthermore, the movement of the rocker arms 3, 3' is in timed relation to the rotation of the cams 12, 13 (12', 13') so that the rocker arms 3, 3' are moved during the time period at which both the intake and exhaust valves are fully closed, i.e., from the closing timing of the intake valve 2 to the opening timing of the exhaust valve 11, thus regulating the moving timing of the rocker arms 3, 3'. Accordingly, the rocker arm follower sections 14, 14' and/or cams 12, 13 are effectively prevented from being damaged due to the fact that the valve lift is initiated in the state where the rocker arms have not yet reached a position at which the follower section 14, 14' are brought into sufficient contact with the cams, excessively increasing the pressure applied per unit area at the contact faces of the rocker arm follower section and the cams.

Figure 11:
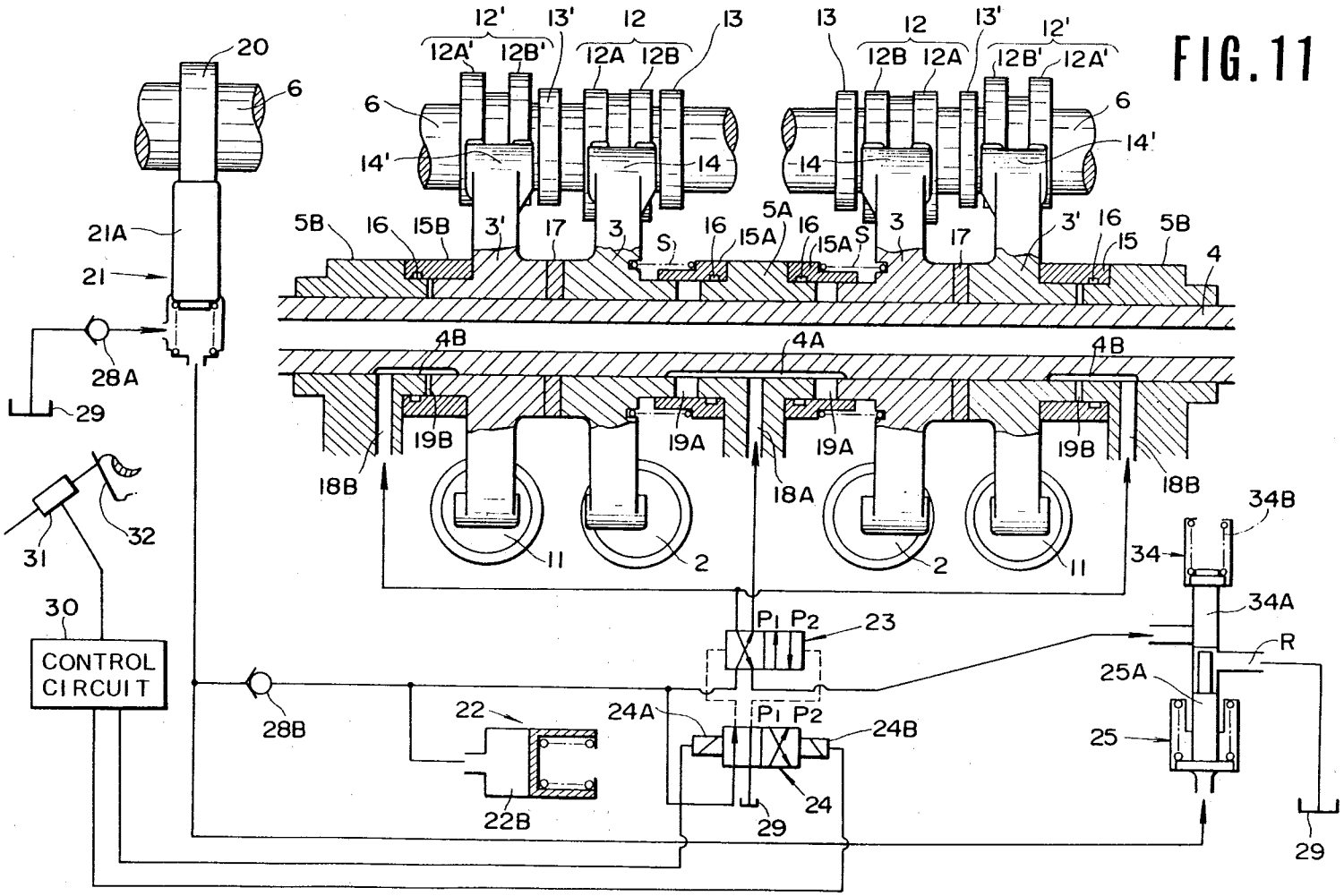
FIG. 11 is a diagram of a modified example of the first embodiment of the system in accordance with the present invention.

FIG. 11 shows a modified example of the first embodiment of the valve operation changing system in accordance with the present invention, in which the restriction of the operation of the flow direction changing valve 23 is made by a stopper valve 34 operatively disposed in an oil restoring passage R communicated with the flow direction changing valve 23, thereby restricting the flow of the oil restored through the restoring passage R to the oil tank 29.

The stopper valve 34 has a piston 34A which is usually urged downward in the drawing by a spring 34B thereby to block the oil restoring passage R. The timing lifter 25 has the piston 25A whose reciprocal motion is made in timed relation to the rotation of the cams 12, 13 (12', 13'). The timing lifter 25 is so arranged that the piston 25A causes the piston 34A of the stopper valve 34 to move upwardly so as to release the block of the oil restoring passage R. The flow direction changing valve 23 is capable of being put into the P1 position or the P2 position. The P1 position corresponds to the extreme left-hand position of the spool 23C of the flow direction changing valve 23 in FIG. 9, while the P2 position corresponds to the extreme right-hand position of the same.

In this case, when the control circuit 30 detects an engine operation at the predetermined light load operating range, the pilot valve 24 is changed from its P1 position to its P2 position, so that the flow direction changing valve 23 is changed from the P1 position to the P2 position. By this changing in the flow direction changing valve 23, the pressurized oil from the accumulator 22 is fed to the hydraulic pressure chamber 19B so as to move the rocker arms 3, 3' onto the cams 13, 13'. However, at this moment, the oil restoring passage R leading to the hydraulic pressure chamber 19A is blocked by the stopper valve 34, and therefore the rocker arms 3, 3' remain biased without being moved.

In this state, at the time point at which the intake valve 2 of the No. 2 cylinder is closed upon the upward movement of the stopper valve piston 34A under the action of timing lifter piston 25A, the block of the oil restoring passage R is released. Thereafter, the valve operation changing system in this case operates as same as that in FIG. 9, so that the rocker arms 3, 3' are smoothly transferred to the respective positions for cylinder deactivation or rest as shown in FIG. 10C. It is to be noted that since the oil pressure in the oil restoring passage R is raised during the transfer of the rocker arms 3, 3' from the cylinder working state to the cylinder rest state, the stopper valve 34 is kept opened to effectively complete the transfer of the rocker arms for the Nos. 2 and 3 cylinders.

As will be appreciated from the above, according to the embodiments of FIGS. 9 and 11, the oil pump in cooperation with the accumulator provides a greater drive speed of the rocker arms which speed corresponds to that by a large capacity oil pump. Since the transfer of the rocker arms is carried out for the time period at which both the intake and exhaust valves are fully closed, the reliability of valve operation changing and the durability of the parts of the system are greatly improved. Furthermore, the reciprocal motion of the timing lifter piston is in timed relation to that of the oil pump piston, and therefore the oil discharge amount of the oil pump becomes substantially zero, thereby resulting in the fact that it is sufficient that the oil pump functions only to supplement the hydraulic oil leaking from the various parts of the system. This sharply reduces the consumed power required for driving the oil pump.

Figure 12:
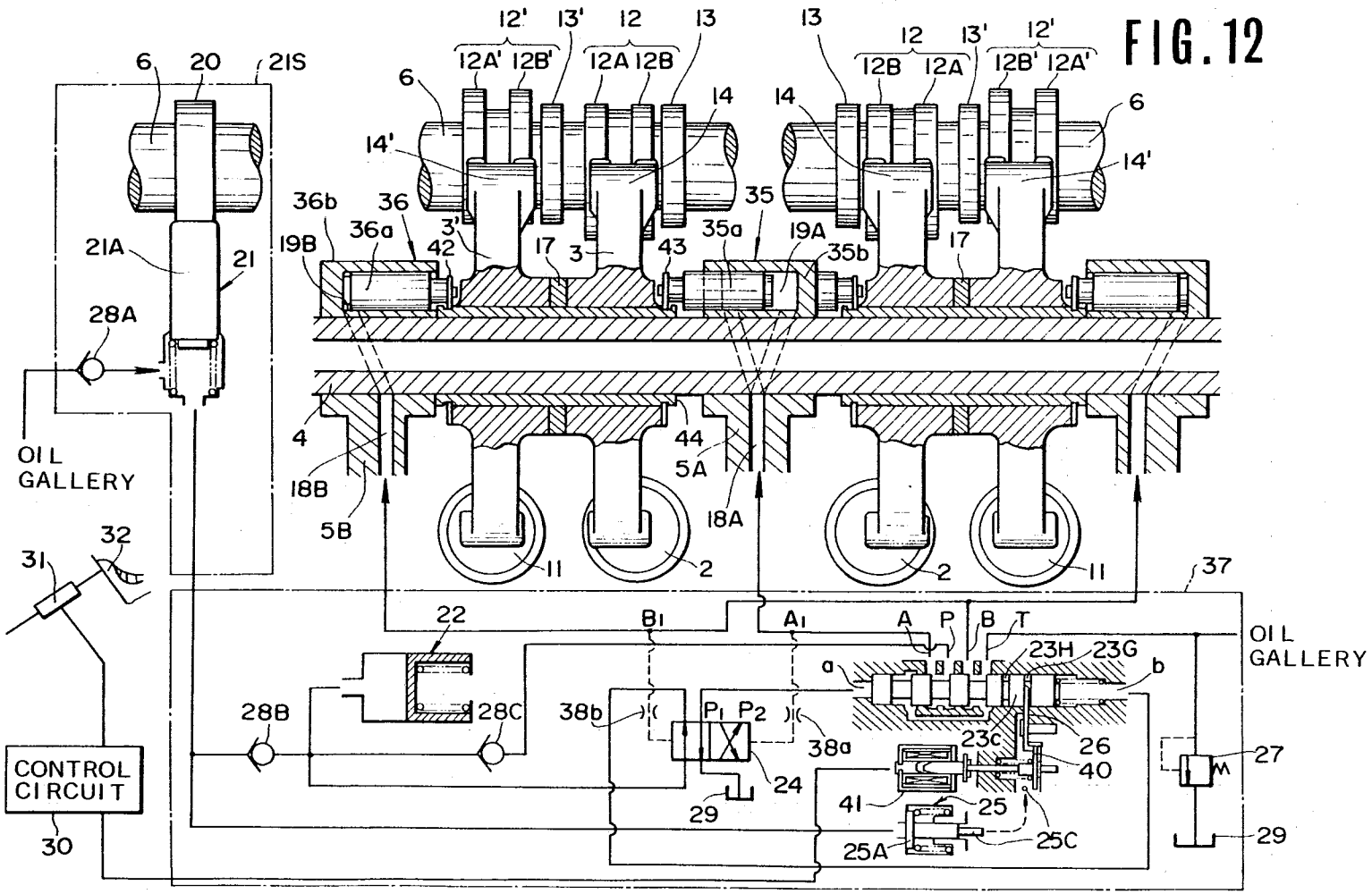
FIG. 12 is a diagram of a second embodiment of the valve operation changing system in accordance with the present invention.
Figure 13:
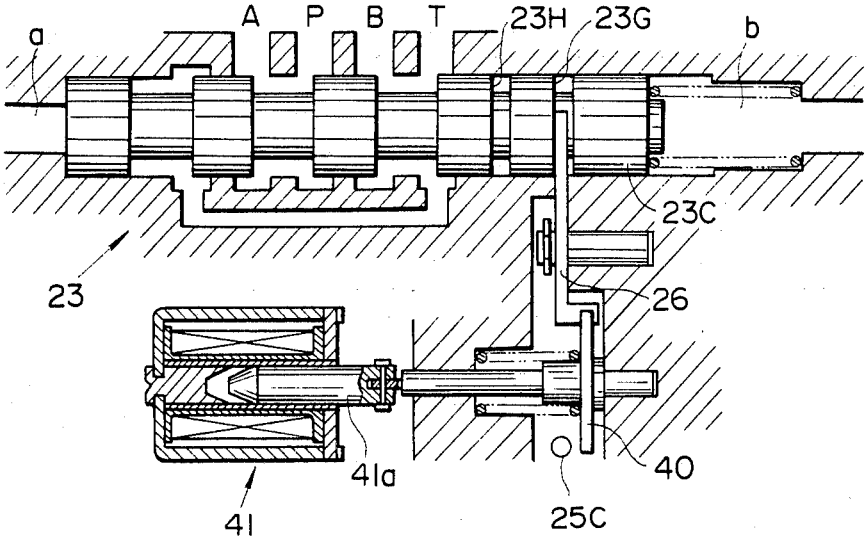
FIG. 13 is an enlarged view of an essential part of FIG. 12.
Figure 14:
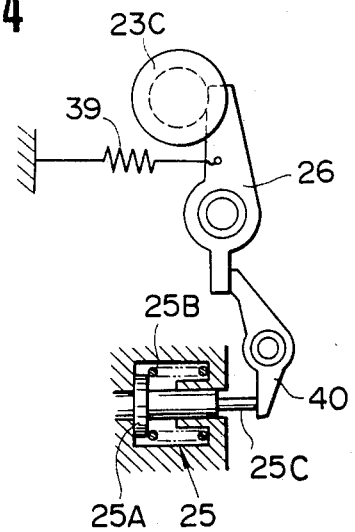
FIG. 14 is a side view of the part shown in FIG. 13.

FIGS. 12 to 14 illustrate a second embodiment of the valve operation changing system in accordance with the present invention, which is similar to the first embodiment exept for means for the driving the rocker shaft 3, 3' and means for restricting the operation of the flow direction changing valve 23.

In this embodiment, the brackets 5A and 5B are integrally formed respectively with hydraulic actuators 35, 36. The actuator 35 includes a piston 35*a* which is movably disposed within a cylinder 35*b*, defining therebetween the hydraulic pressure chamber 19A which is filled with the oil through the pressure passage 18A. Likewise, the actuator 36 includes a piston 36*a* which is movably disposed within a cylinder 36*b*, defining therebetween the hydraulic pressure chamber 19B. The pistons 35*a*, 35*b* are engaged through engaging members 42 and 43 with the opposite ends, respectively, of a sleeve 44 through which the rockers arms 14, 14' are rotatably mounted on the rocker shaft 4. Additionally, the two rocker arms 3, 3' are movable in the axial direction together with the sleeve 44. It will be understood that the piston 35*a* and 36*a* move so as to project from the cylinders 35*b*, 36*b*, respectively, thus selectively locating the rocker arm 3, (3') onto one of the cam 12 (12') for cylinder activation or working and the cam 13 (13') for cylinder deactivation or rest. Though not shown, a spring is interposed between the bracket 5A and the rocker arm 14 to urge the rocker arms to be located on the cams 12, 12' for causing all the cylinder to work even at engine starting where the oil pressure has not yet been raised to a predetermined level.

The oil pump 21 forming part of an oil pump section 21S is arranged to pressurize the oil from an oil gallery and supply it into a hydraulic pressure control section 37 including the accumulator 22, the flow direction control valve 23, and the pilot valve 24. The oil gallery leads to the oil tank 29. The pilot valve 24 is so arranged to receive an oil pressure A1 developed between the port A of the flow direction changing valve 23 and the hydraulic pressure chamber 19A, and an oil pressure B1 developed between the port B of the valve 23 and the hydraulic pressure chamber 19B. It will be understood that the pilot valve 24 takes the P1 position or the P2 position in accordance with the difference between the oil pressure A1 introduced through a throttled portion or orifice 38*a* and the oil pressure B1 introduced through a throttled portion or orifice 38*b*, thereby supplying the oil pressure from the accumulator 22 into either one of side chambers a, b which are located at the opposite sides of the flow direction changing valve spool 23C, the remaining side chamber being connected to the oil tank 29 to restore the oil thereinto. Thus, the oil pressures A1, B1 varied by the position change of the flow direction changing valve spool 23C causes the pilot valve 24 to operate in a manner to restore the spool 23C to the initial position.

In this embodiment, the stopper 26 is engageable with either one of the annular grooves 23G, 23H of the spool 23C so as to lock the spool 23C at one of two positions. The stopper 26 is usually urged to engage with the groove 23G, 23H under the bias of a spring 39 as shown in FIG. 14. The engagement of the stopper 26 with the groove 23G, 23H is released by rotating the stopper 26 in the direction opposite to the urging direction of the spring 39. Such rotation of the stopper 26 is made by rotating an arm 40 counterclockwise in FIG. 14 upon engagement with a projectable rod 25C of the timing lifter 25. It is to be noted that the engagement of the arm 40 and the timing lifter rod 25C is made only when an electromagnetic actuator 41 is in its attracting state in which a movable rod 41*a* moves leftward in FIG. 13. As seen from FIG. 13, the leftward movement of the actuator rod 41*a* causes the arm 40 to be engaged with the timing lifter projectable rod 25C. The projectable rod 25C of the timing lifter 25 is connected to the piston 25A which directly receives the oil pressure from the oil pump 21, so that the rod 25C makes its reciprocal motion in timed relation to the reciprocal motion of the oil pump piston 21A or the rotation of the cams 12, 12'.

The electromagnetic actuator 41 is arranged to be energized a predetermined time period to attract the rod 41*a* leftward in FIG. 13 when the engine operation is changed from a predetermined high engine load range to a predetermined low engine load range, or from the predetermined low engine load range to the predetermined high engine load range. This energization of the electromagnetic actuator 41 is accomplished by the control circuit 30 which receives a signal from the engine load or acceleration sensor 31 which senses the depression amount of the acceleration pedal 32.

With the thus arranged valve operation changing system of FIGS. 12 to 14, when all the cylinders are in the activated or working state, the spool 23C of the flow direction changing valve 23 is in the position shown in FIGS. 12 and 13, so that the hydraulic oil pressure is introduced into the hydraulic pressure chamber 19A. As a result, the rocker arms 3, 3' are driven by the cams 12, 12' for cylinder working as shown in FIG. 12. In this state, the oil pressure A1 applied to the pilot valve 24 is greater than the oil pressure B1 applied to the pilot valve 24, and accordingly the pilot valve 24 is put into the P2 position so as to cause the oil pressure to be applied to the chamber a of the flow direction changing valve 23. This allows the spool 23C of the flow direction changing valve 23 to be moved to the position opposite to the position shown in the drawing; however, such movement of the spool 23C is obstructed by the stopper 26.

From this state, when the control circuit 30 detects a predetermined reduction of engine load in accordance with an output variation of the acceleration sensor 31, the electromagnetic actuator 41 is energized the predetermined time period to move the arm 40 leftward in FIG. 13. Accordingly, the rod 25C of the timing lifter 25 and the arm 40 are put into the state where they are possible to be engaged with each other. Now, the rod 25C of the timing lifter 25 makes its reciprocal motion in timed relation to the lift of the cams 12, 12', and arranged to be projected so as to rotate the stopper 26 through the arm 40, thus releasing the engagement of the stopper 26 with the spool 23C in the vicinity of bottom dead center. Such engagement release at the predetermined timing is accomplished by suitably setting the phase of the cam 20 for driving the oil pump 21. When the engagement of the stopper 26 is released, the spool 23C of the flow direction changing valve 23 is moved rightward in FIG. 13 and locked in this state where the stopper 26 engages with the groove 23H of the spool 23C. This is because the lift of the timing lifter 25 is not made until the accumulator 22 is again filled with the oil, in which the electromagnetic actuator 41 is again deenergized.

Figure 15:
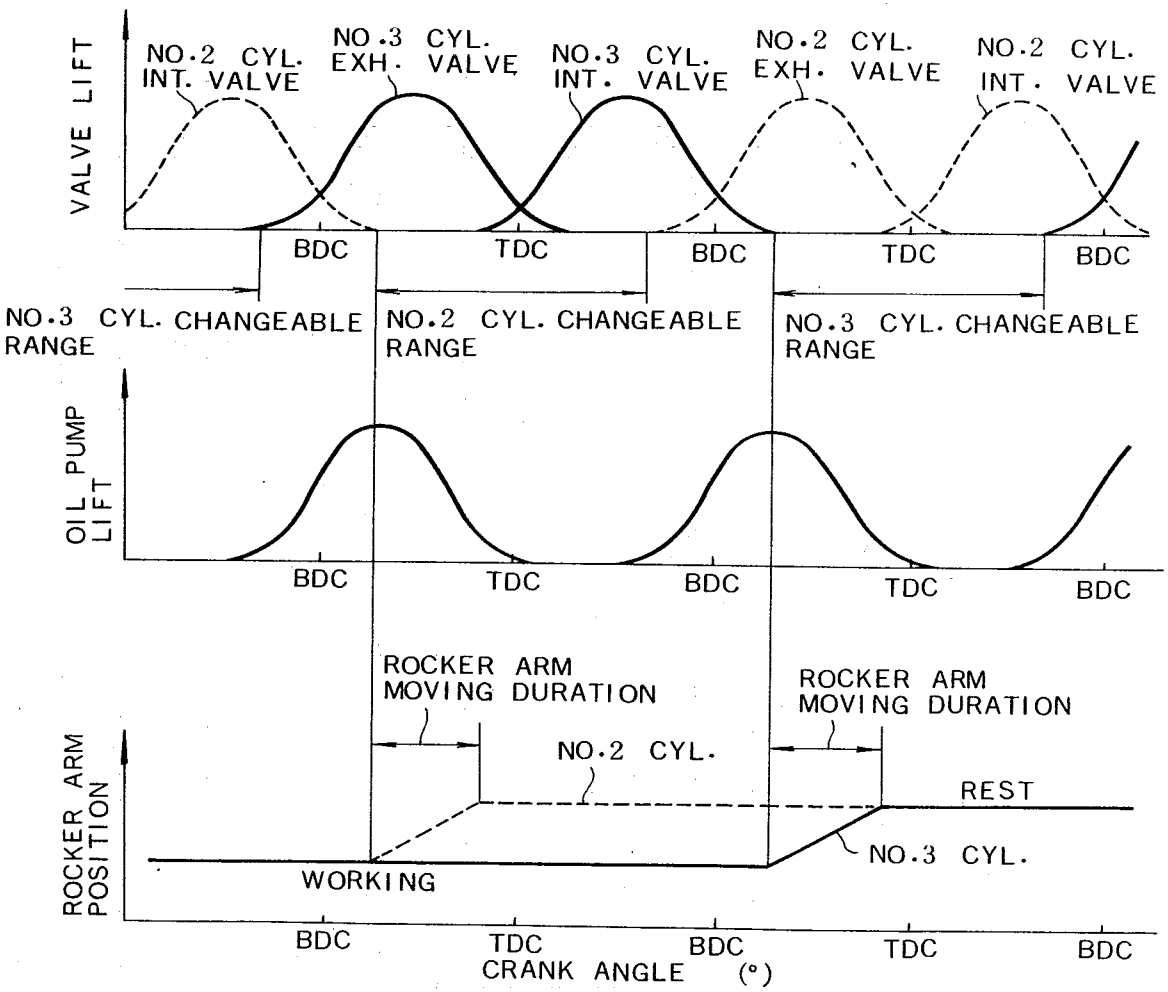
FIG. 15 is a graphical representation showing the timing of the movement of rocker arms.

Under the thus shifted condition of the flow direction changing valve 23, the oil pressure from the accumulator 22 is supplied to the hydraulic pressure chamber 19B, while the oil pressure within the hydraulic pressure chamber 19A is discharged. Now, referring to FIG. 15, when the usual lift of the intake valve 2 in the No. 2 cylinder is terminated after bottom dead center, a clearance is made between the contacting surfaces of the rocker arm 3, 3' and the cam 12, 12', so that the rocker arm 3, 3' are moved at a stretch onto the cams 13, 13', respectively. Then, the usual lift of the exhaust valve 11 of the No. 3 cylinder has already been initiated before bottom dead center. In this state, even when the spool 23C of the flow direction changing valve 23 is moved, the rocker arms 3, 3' do not move axially until the succeeding lift of the intake valve 2 is terminated. Because, at least one of the cams 12, 12' is driving the rocker arm 3, 3', and a considerable frictional force is developed between the contact surfaces of the rocker arm 3, 3' and the cam 12, 12' under the bias of the valve spring (not shown). When a clearance is made between the contact surfaces of the rocker arm 3, 3' and the cam 12, 12' at the time point where the usual lift of the intake valve 2 has been terminated, the rocker arms 3, 3' for the No. 3 cylinder are moved at a stretch onto the cams 13, 13' for cylinder deactivation or rest, thereby completing the valve operation changing action as shown in FIG. 15.

Additionally, when the position of the spool 23C of the flow direction changing valve 23 is shifted, the magnitude of the oil pressures A1, B1 is reversed to change the positions P1, P2 of the pilot valve 24, the oil pressure from the pilot valve 24 acts on the flow direction changing valve 23 in a manner to restore the spool 23C to the initial position. However, the spool 23C of the flow direction changing valve 23 is locked, and therefore the position of the spool 23C is actually not changed so as to stand ready for the next position shift. Thus, by previously changing signal oil pressures to the flow direction changing valve 23, the position shift of the flow direction changing valve spool 23C takes place at a stretch when the engagement of the stopper 26 is released in the valve operation change, thereby improving the response in the valve operation change.

Figure 16:
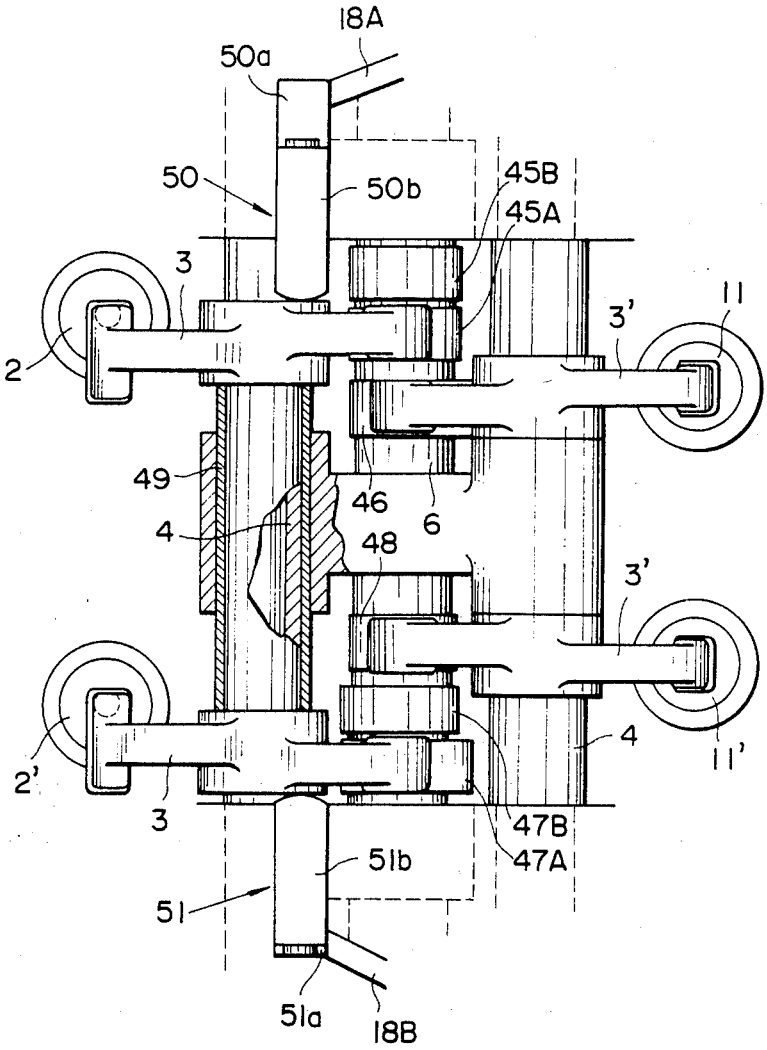
FIG. 16 is a plan view of an essential part of a third embodiment of the valve operation changing system in accordance with the present invention.
Figure 18:
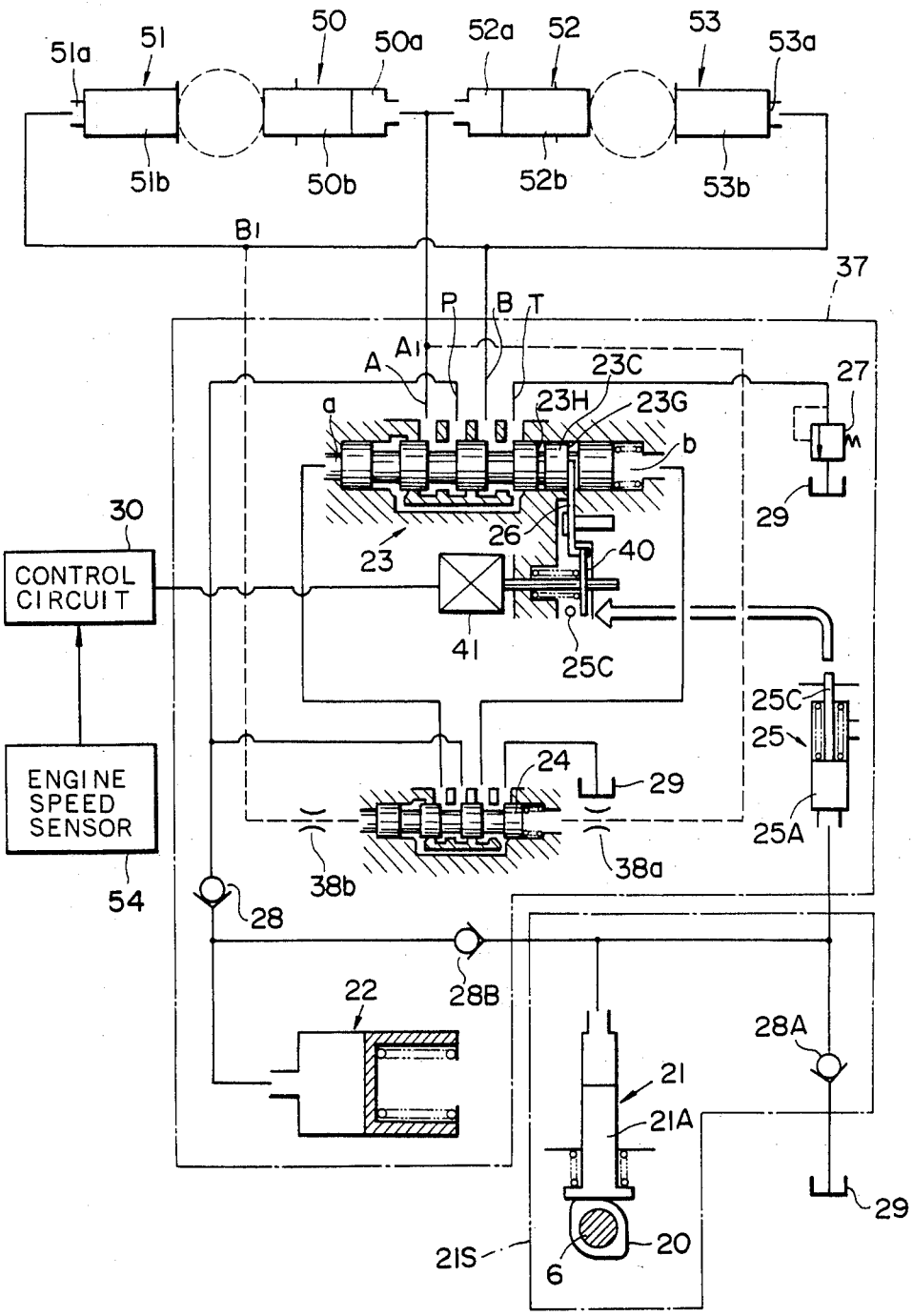
FIG. 18 is a diagram illustrating in detail the valve operation changing system of FIG. 16.

FIGS. 16 and 18 illustrates a third embodiment of the valve operation changing system according to the present invention, applied to a dual-mode internal combustion engine of the four-cylinder type wherein the firing order of four cylinders (cylinder Nos. 1 to 4) is No. 1—No. 3—No. 4—No. 2, and only respective intake valves 2, 2' for all the cylinder are arranged to be changed in their valve operation in accordance with engine operating conditions. In FIG. 16, the reference numeral 2 denotes the intake valve of the No. 1 cylinder, 11 the exhaust valve of the No. 1 cylinder, 2' the intake valve of the No. 2 cylinder, and 11' the exhaust valve of the No. 2 cylinder. The Nos. 1 and 2 cylinders are located side by side.

The camshaft 6 is formed with two cams 45A, 45B which are located side by side for driving the intake valve 2 and different in cam profile from each other. The cam 45A is used for a high engine speed operation, while the cam 45B is used for a low engine speed operation. The camshaft 6 is further formed with two cams 47A, 47B which are located side by side for driving the intake valve 2' and different in cam profile from each other. The cam 47A is used for the high engine speed operation, while the cam 47B is used for the low engine speed operation. In this case, the exhaust valves 11 and 11' are not changed in their valve operation in accordance with engine operating conditions, and therefore only one cam 46 for the exhaust valve 11 and only one cam 48 for the exhaust valve 11' are securely formed on the camshaft 6.

Figure 17:
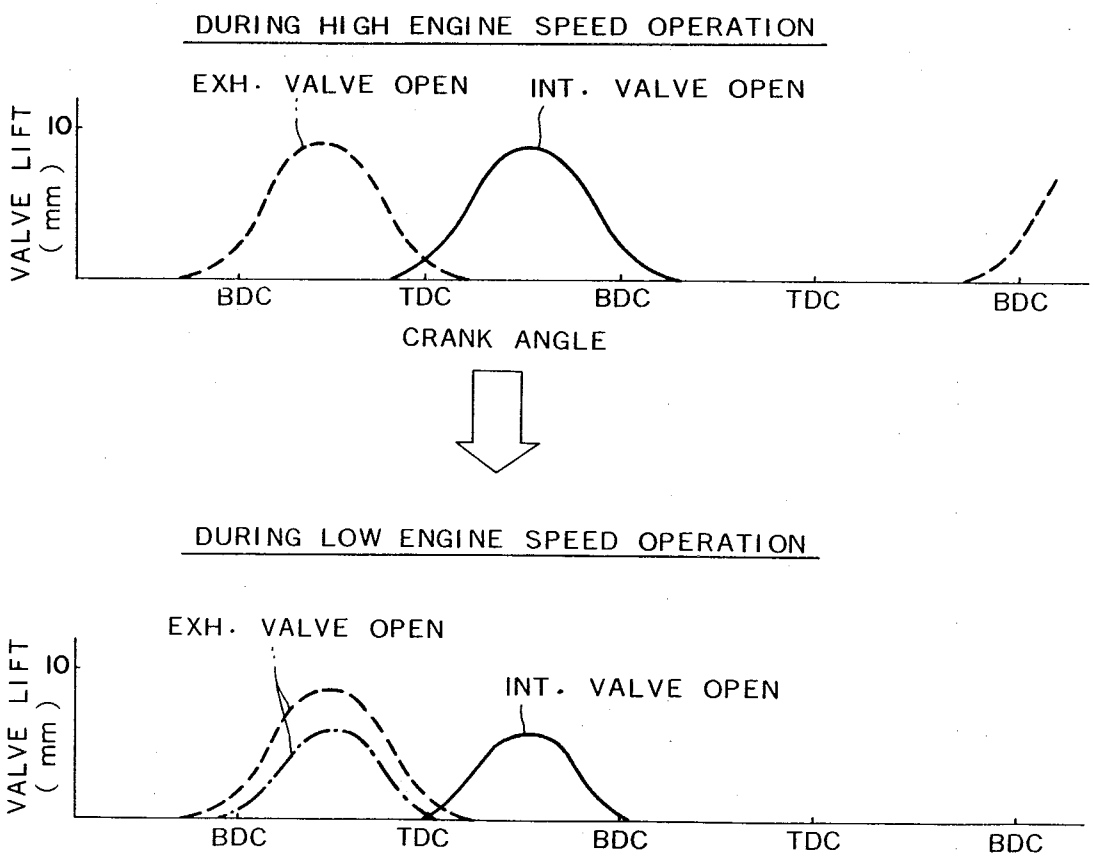
FIG. 17 is a graphical representation showing the manners of valve lift respectively in different engine operation modes.

According to the cam profile of the cams 45A, 47A for the high engine speed operation, the valve overlap between the intake and exhaust valves is relatively enlarged, whereas according to the cam profile of the cams 45B, 47B for the low engine speed operation, the valve overlap is relatively reduced as shown in FIG. 17 in which solid lines indicate the valve lift of the intake valve, and broken lines indicate the valve lift of the exhaust valve. The rocker arms 3, 3 for the intake valves 2, 2' are located in position through a collar 49 interposed therebetween. The axial movement of the rocker arms 3, 3 are controlled by two hydraulic actuators 50, 51, and each rocker arm 3 is arranged to selectively engage with one of the cam 45A, 47A for the high engine speed operation and the cam 45B, 47B for the low engine speed operation.

With respect to the neighbouring Nos. 3 and 4 cylinders (not shown), the same valve operating mechanism as in the Nos. 1 and 2 are installed, in which the axial movement of rocker arms (not shown) for intake and exhaust valves of the Nos. 3 and 4 cylinders is controlled by two hydraulic actuators 52, 53, and each rocker arm is arranged to selectively engage with one of a cam (not shown) for the high engine speed operation and a cam (not shown) for the low engine speed operation.

These hydraulic actuators 50, 51, 52 and 53 are so arranged that pistons 50*b*, 51*b*, 52*b* and 53*b* are lifted or projected by the hydraulic pressures within hydraulic pressure chambers 50*a*, 51*a*, 52*a* and 53*a*, respectively. In this connection, a hydraulic control system for the incorporated two actuators 50, 51 and the incorporated two actuators 52, 53 are clearly shown in FIG. 18.

In this case, the electromagnetic actuator 41 is electrically connected to the control circuit 30 which receives a signal from engine speed sensor 54. The control circuit 30 is so arranged to supply electric current to the electromagnetic actuator 41 a predetermined time duration when the engine operation is shifted from a predetermined high engine speed range to a predetermined low engine speed range, or when the engine operation is shifted from the predetermined low engine speed range to the predetermined high engine speed range.

In operation, in the predetermined high engine speed operating range, the spool valve 23C of the flow direction changing valve 23 is positioned in FIG. 18, and accordingly the hydraulic pressure chambers 50*a*, 52*a* are supplied with high pressure hydraulic oil, so that the rocker arms 3, 3 for the intake valves 2, 2' of the Nos. 1 and 2 cylinders are driven by the cams 45A, 47A for the high engine speed operation, respectively, as shown in FIG. 16. Additionally, the rocker arms for the intake valves of the Nos. 3 and 4 cylinders are driven by the cams for the high engine speed operation, respectively, though not shown. As a result, in the high engine speed operating range, the valve overlap is enlarged so as to improve the charging efficiency of intake air, thereby increasing the power output of the engine. At this time, since the oil pressure A1 applied to the pilot valve 24 is higher than the oil pressure B1, the pilot valve 24 is in the state shown in FIG. 18, so that the oil pressure is applied to the chamber a of the flow direction changing valve 23. Accordingly, it seems that the spool 23C of the flow direction changing valve 23 is moved to an opposite position to change flow direction of the pressurized oil; however, such movement of the spool 23C is blocked by the stopper 26 engaged with the groove 23G of the spool 23C.

From this state, when the engine operation is shifted to the predetermined low engine speed range, i.e., the control circuit 30 detects the lowering in engine speed into a predetermined low engine speed range, the electromagnetic actuator 41 is energized a predetermined time duration to move the arm 40 leftward in the drawing, so that the arm 40 moves to a position to be engageable with the output rod 25C of the timing lifter 25. The rod 25C of the timing lifter 25 reciprocally moves in timed relation to the cam lift of the cam 20 for driving the oil pump 21. Accordingly, the projection of the rod 25C is made in accordance with the cam phase of the cam 20. This causes the stopper 26 to rotate through the arm 40, thereby releasing the engagement of the stopper 26 with the spool groove 23G.

When the engagement of the stopper 26 is thus released, the spool 23C of the flow direction changing valve 23 is shifted to the extreme right-hand position, and locked there upon engagement of the stopper 26 with the groove 23H. In the thus changed state of the flow direction changing valve 23, the oil pressure from the accumulator 22 is supplied to the hydraulic pressure chambers 51*a*, 53*a*, while the oil pressure within the hydraulic pressure chambers 50*a*, 52*a* is released to the oil tank 29.

Figure 19:
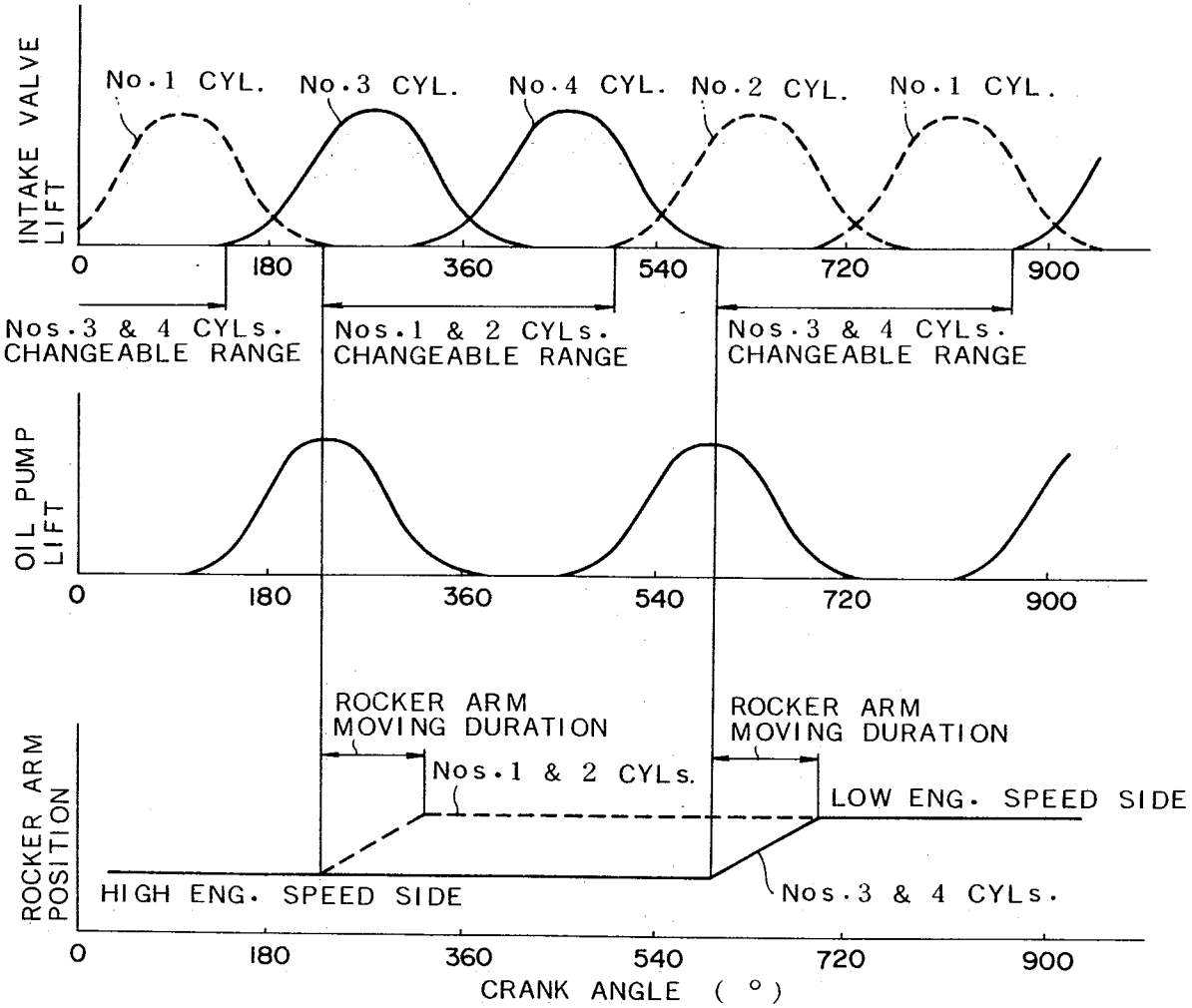
FIG. 19 is a graphical representation showing the timings of the movement of rocker arms.

Referring now to FIG. 19, with respect to the Nos. 1 and 2 cylinders, when the high engine speed operation valve lift of the intake valve 2 of the No. 1 cylinder is terminated after the timing of 180 degrees in crank angle, a clearance is made between the contact faces of the rocker arm 3, 3 and the cam 45A, 47A of the Nos. 1 and 2 cylinders, so that the rocker arms 3, 3 are moved at a stretch toward the sides of the cams 45B, 47B for the low engine speed operation. Consequently, the rocker arms 3, 3 are brought into contact or engagement with the cams 45B, 47B, respectively.

With respect to the No. 3 cylinder, although the high engine speed operation valve lift of the intake valve has been already initiated and the position of the flow direction changing valve spool 23C is shifted, the rocker arm cannot move in its axial direction until the succeeding high engine speed operation valve lift of the intake valve of the No. 4 cylinder is terminated because at least one of the Nos. 3 and 4 cylinder intake valves is driven by the cam for the high engine speed operation and because of a higher frictional force to the rocker arm. However, a clearance is made between the rocker arm and the cam at the time point at which the high engine speed operation valve lift of the intake valve of the No. 4 cylinder has been terminated, and consequently the rocker arms for the Nos. 3 and 4 cylinders move at a stretch, thus completing rocker arm transferring.

After the completion of rocker arm transferring, the rocker arms 3, 3 for the Nos. 1 and 2 cylinders lie in the positions opposite to those shown in FIG. 16, and accordingly are respectively driven by the cams 45B, 47B for the low engine speed operation, so that the valve overlap of the intake and exhaust valves is reduced. This prevents the reverse flow of exhaust gas to the cylinders, thereby improving the charging efficiency even in a low engine speed operating range so that a required power output can be maintained.

When the position of the flow direction changing valve spool 23C is shifted, the magnitude relationship between the two oil pressures applied to the pilot valve 24 is reversed so that the spool position of the pilot valve 24 is shifted. Consequently, the signal oil pressure from the pilot valve 24 so acts on the flow direction changing valve 23 as to restore the spool 23C to the initial position. However, the spool 23C is locked by the stopper 26, and therefore such a shift of the spool 23C is in practice not carried out, standing ready to the camming spool shift.

Thus, since the rocker arms for the neighbouring cylinders are incorporated with each other and are moved as a single member, two pairs of actuators for the rocker arms are sufficient in the case of the four-cylinder engine, thereby reducing by half the number of actuators as compared with cases wherein one actuator is used for each rocker arm.

While the valve operation changing of only the intake valves has been shown and described in the embodiment of FIGS. 16 and 18, it will be understood that the valve operation changing of only the exhaust valves may be carried out. Additionally, the same valve operation changing mechanism as in the intake valves may be provided for the exhaust valves, in which two cams are provided for each exhaust valve. Of the two cams, one for the high engine speed operation has the valve lift characteristics shown in the upper figure of FIG. 17, while the other one has a valve lift characteristics indicated by a dot-dash line in the lower figure of FIG. 17. Such changing the valve operation of both the intake and exhaust valves further reduces the valve overlap of the intake and exhaust valves in the low engine operating range, thereby maintaining charging efficiency higher.

Although the above explanation of the embodiment of FIGS. 16 and 18 has been made on the engine whose firing order of the four cylinders is No. 1—No. 3—No. 4—No. 2, it will be understood that the valve operation changing system of the same embodiment is applicable to the engine whose firing order of four cylinders is No. 1—No. 2—No. 4—No. 3.

Figure 20:
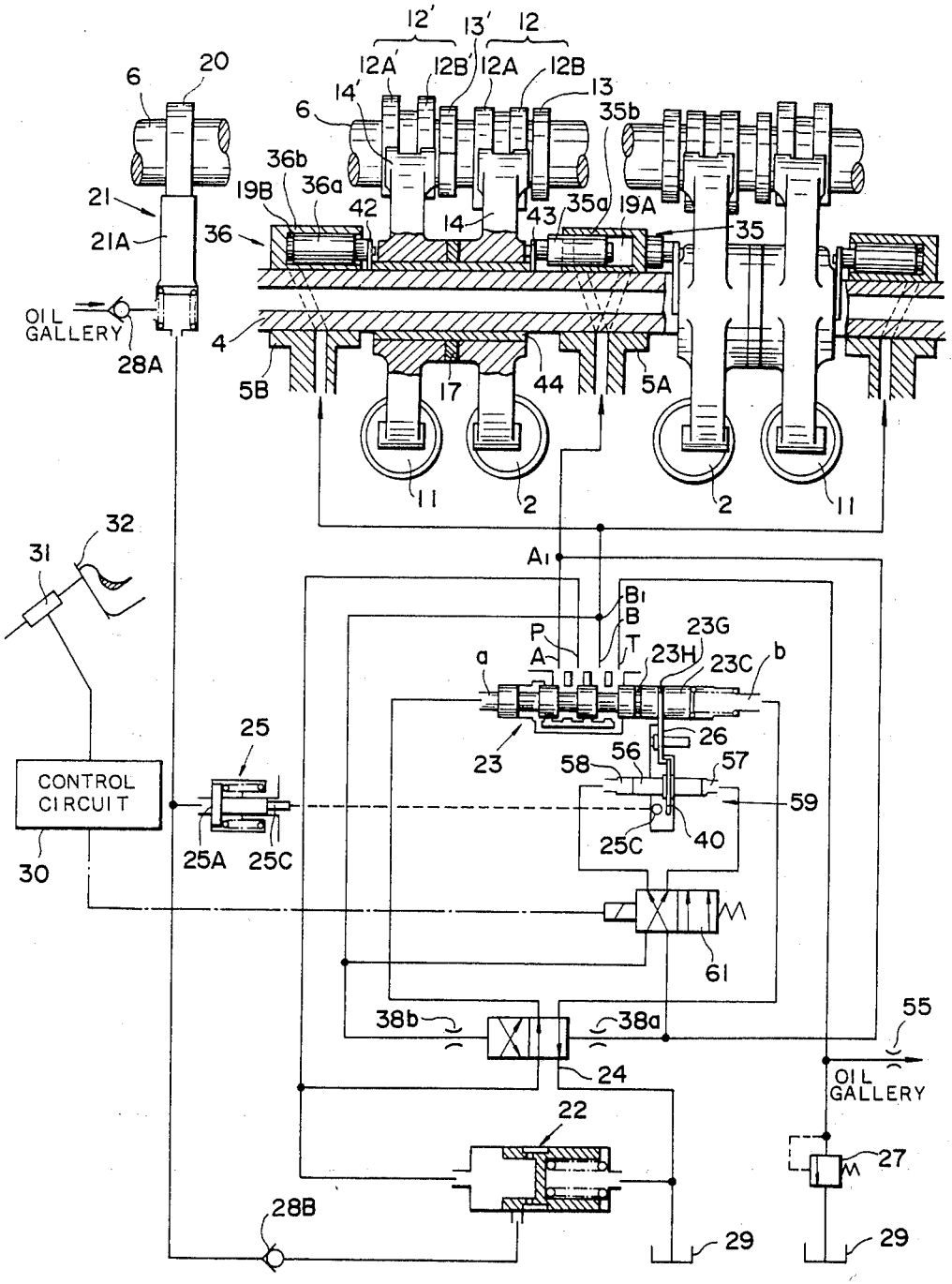
FIG. 20 is a diagrammatic view showing a fourth embodiment of the valve operation changing system in accordance with the present invention.

FIG. 20 illustrates a fourth embodiment of the valve operation changing system according to the present invention, which is similar to the second embodiment shown in FIGS. 12 to 14 except for the hydraulic control system, and therefore an explanation will be made in detail for the hydraulic control system.

As shown, the oil pump 21 includes the piston 21A which is driven by the cam 20 formed on the camshaft 6. The oil pump 21 functions to pressurize hydraulic oil sucked from the oil gallery via the check valve 28A. The discharge side of the oil pump 21 is fluidly connected to the timing lifter 25, and via the check valve 28B to the accumulator 22 which is in turn fluidly connected to the port P of the flow direction changing valve 23. The flow direction changing valve 23 is so arranged that either one of the opposite side chambers a and b is supplied with signal hydraulic pressures from the pilot valve 24 in order to shift the spool 23C to the extreme left-hand or right-hand position in the drawing so that the port P is fluidly connected to either one of the ports A and B. The port A is fluidly connected to the hydraulic pressure chamber 19A of the hydraulic actuator 35, while the port B is fluidly connected to the hydraulic pressure chamber 19B of the hydraulic actuator 36. Additionally, when one of the ports A and B is in communication with the port P, the other becomes in communication with the port T. The port T is fluidly connected to the oil gallery side through an orifice 55 and also to the oil tank 29 through the relief valve 27.

Figure 21:
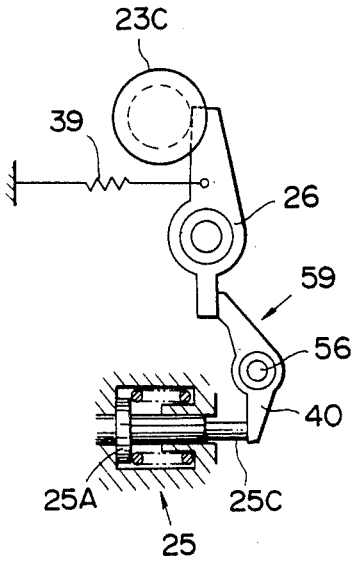
FIG. 21 is an enlarged side view of a part of the system of FIG. 20.

The pilot valve 24 is arranged to receive the pressure A1 developed between the port A and the hydraulic pressure chamber 19A and the pressure B1 developed between the port B and the hydraulic pressure chamber 19B, and is shifted in accordance with the difference between the pressures A1 and B1 so as to supply either one of the chambers a and b of the flow direction changing valve with oil pressure from the accumulator 22, the other chamber being fluidly connected to the oil tank 29. The pilot valve 24 is shifted in such a manner as to shift the flow direction changing valve 23 to the initial position by the oil pressures A1, B1 which have varied due to the shifting of the flow direction changing valve 23. The flow direction changing valve spool 23C is formed in the axial direction with the grooves 23G, 23H with which the stopper 26 is engageable to lock the spool 23C at the extreme left-hand or right hand position. The stopper 26 is biased in the direction to engage the groove 23G, 23H by the spring 39 as shown in FIG. 21.

The timing lifter 25 functions to release the engagement of the stopper 26, and so arranged that its piston 25A directly receives the oil pressure from the oil pump 21 to reciprocally move the output rod 25C in timed relation to the lift of the oil pump piston 21A, i.e., the lift of the cams 12, 13, 12', 13'. The output rod 25C of the timing lifter 25 is engageable with one end of the lever 40 the other end of which is engageable with the stopper 26 as shown in FIG. 21. Accordingly, the stopper 26 is released from the spool groove when the output rod 25C causes the stopper 26 to rotate through the arm or lever 40 against the bias of the spring 39. It is to be noted that the lever 40 is axially movable together with a shaft 56 on which the lever 40 is rotatably mounted, so that the output rod 25C does not engage with the the lever 40 when the lever 40 has been moved rightward as shown in FIG. 20, while engages with the lever 40 to release the stopper from the spool groove only when the lever 20 is moved leftward in FIG. 20.

A hydraulic clutch 59 includes the shaft 56 which forms a piston of a double-acting cylinder in which two hydraulic chambers 57, 58 are formed on the opposite sides relative to the piston 56. In other words the opposite ends of the shaft or piston 56 define the hydraulic chambers 57, 58, respectively. Thus, the shaft 56 forms part of a hydraulic clutch 59. The hydraulic chambers 57, 58 are suppliable with the oil pressures A1, B1 through an electromagnetic flow direction shifting valve 61. The flow direction shifting valve 61 is so arranged as to be energized by the control circuit 30 in a high engine load operating condition, which control circuit 30 receives a signal from an acceleration sensor or the engine load sensor 31 for sensing the depression amount of the acceleration pedal 32. When the flow direction shifting valve 61 is energized, it is so shifted that the oil pressure A1 is introduced into the hydraulic pressure chamber 58 while the oil pressure B1 is introduced into the hydraulic pressure chamber 57. On the contrary, in a low engine load operating condition, the flow direction shifting valve 61 is deenergized to be so shifted that the oil pressure A1 is introduced into the hydraulic pressure chamber 57 while the oil pressure B1 is introduced into the hydraulic pressure chamber 58.

The manner of operation of the system of FIGS. 20 and 21 will now be discussed.

When all the cylinders are working in which the flow direction changing valve 23 is shifted as shown in FIG. 20, oil pressure is introduced into the hydraulic pressure chamber 19A of the hydraulic actuator 35 and therefore the rocker arms 14, 14' are driven by the cams 12, 12', respectively, for working or activating the cylinders 2, 11. At this time, since the oil pressure A1 is higher than the other of the pressures acting on the pilot valve 24, the pilot valve 24 has been shifted in the state shown in FIG. 20, thereby introducing the oil pressure into the chamber a of the flow direction changing valve 23. Consequently, the flow direction changing valve 23 is in a shiftable condition; however, the spool 23C is locked by the stopper 26, thereby preventing the shifting of the flow direction changing valve 23.

At this time, the electromagnetic flow direction shifting valve 61 has been shifted in the state shown in FIG. 20, so that the higher oil pressure A1 is introduced into the hydraulic pressure chamber 58 of the hydraulic clutch 59. Accordingly, the lever 40 has been moved rightward together with the shaft 56 as shown in FIG. 20, in which the output rod 25C of the timing lifter 25 is not brought into engagement with the the lever 40 and therefore the stopper 26 is not released even upon the reciprocal movement of the timing lifter output rod 25C.

From this state, when the control circuit 30 detects an engine operating condition variation or a reduction in engine load upon an output variation from the acceleration sensor 31, the electromagnetic flow direction shifting valve 61 is deenergized to be shifted into the state opposite to that shown in FIG. 20.

Figure 22C:
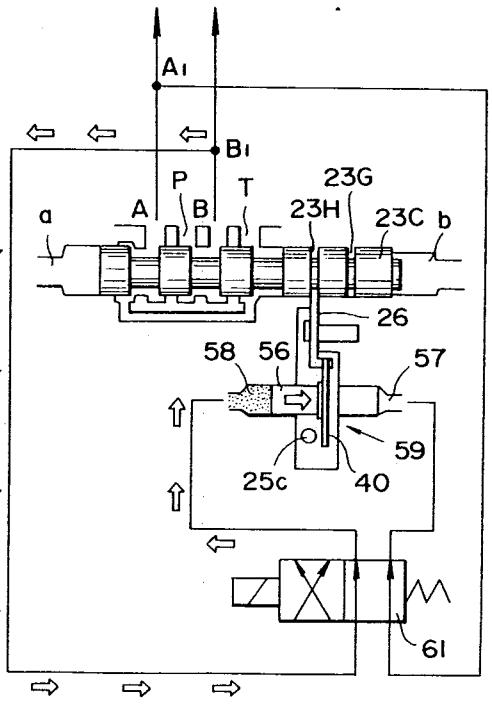
FIGS. 22A to 22C are schematic views illustrating the operation of an essential part of the system of FIG. 20.
Figure 22B:
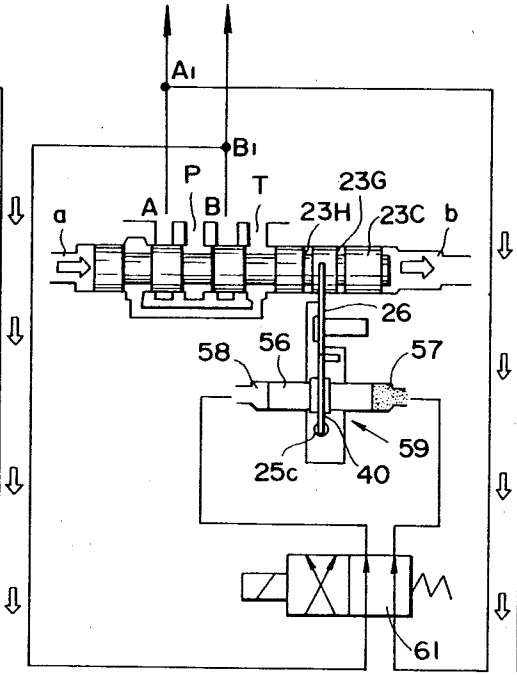
Figure 22A:
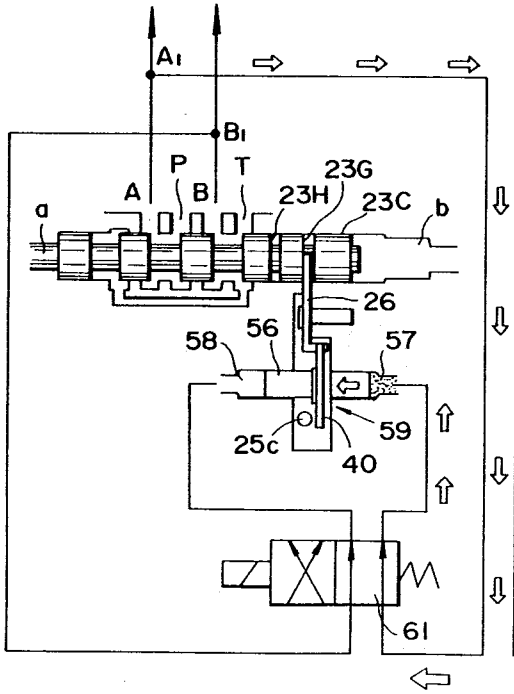

FIGS. 22A to 22C show the operation of the hydraulic clutch 59, the stopper 26, and the flow direction changing valve 23 after the moment at which the electromagnetic flow direction shifting valve 61 has been deenergized as mentioned above. Initially, the electromagnetic flow direction shifting valve 61 has been shifted as shown in FIG. 22A, and consequently the higher oil pressure A1 is introduced into the hydraulic pressure chamber 57 of the hydraulic clutch 59, so that the lever 40 is initiated to move leftward together with the shaft 56. And when the movement of the lever 40 has been completed as shown in FIG. 22B, the timing lifter output rod 25C becomes engageable with the lever 40. With respect to the timing lifter 25, its output shaft 25C makes the reciprocal motion in timed relation to the lift of the cams 12, 12', and therefore, referring to FIG. 23, the timing lifter output rod 25C is projected at a timing at which the usual lift of the intake valve 2 of the No. 2 cylinder (which makes the shifting between the working and rest) is completed, or a timing at which the usual lift of the intake valve 2 of the No. 3 cylinder is completed.

Accordingly, after the completion of the leftward movement of the lever 40 in FIG. 20, the timing lifter output rod 25C rotates the stopper 26 through the lever 40, thereby releasing the stopper 26. When the stopper 26 is released, the flow direction changing valve spool 23C is shifted to the extreme right-hand position as shown in FIG. 21C, and then locked as it is by the stopper 26. At this moment, the port P is brought into communication with the port B while the port A is brought into communication with the port T, so that the oil pressure B1 becomes higher than the oil pressure A1. The higher oil pressure B1 is introduced through the electromagnetic flow direction shifting valve 61 into the hydraulic pressure chamber 58, thereby reversing the magnitude relationship between the oil pressures applied to the shaft 56 of the hydraulic clutch 59 as shown in FIG. 22C. This restores the lever 40 to the initial position. Consequently, immediately after the completion of shifting of the flow direction changing valve 23, the hydraulic clutch 59 is put into the released state. Therefore, the hydraulic clutch 59 is maintained in the released state upon deenergization of the electromagnetic flow direction shifting valve 61, and the stopper 26 is securely kept in the locked state. In the state where the flow direction changing valve 23 has been shifted, the oil pressure from the accumulator 22 is supplied to the hydraulic pressure chamber 19B of the hydraulic actuator 36, whereas the oil pressure in the hydraulic pressure chamber 19A of the hydraulic actuator 35 is released.

Figure 23:
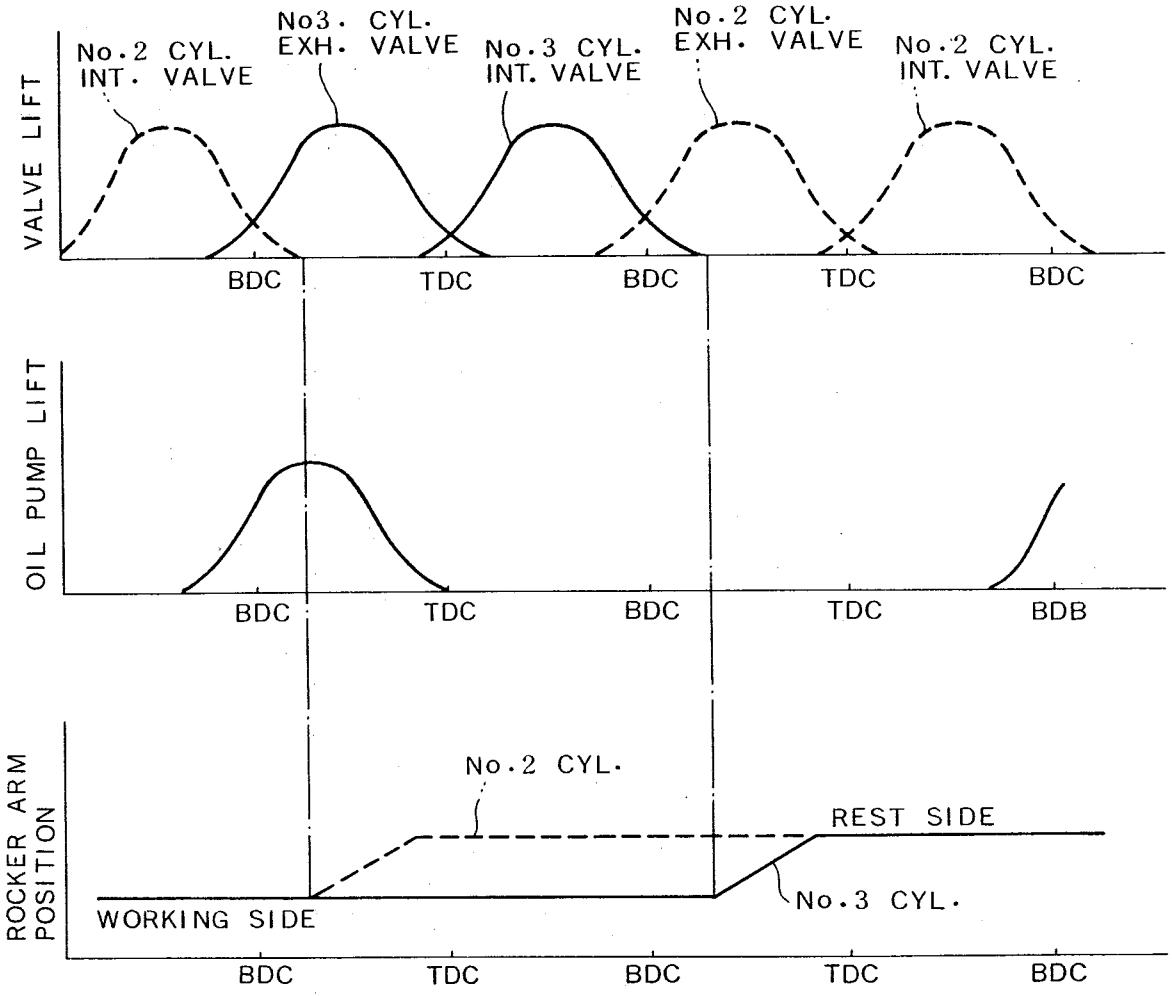
FIG. 23 is a graphical representation showing the timings of the movement of rocker arms.

Here, referring to FIG. 23, in the No. 2 cylinder, the usual lift of intake valve 2 has been terminated and the rocker arms 14, 14' of both the intake and exhaust valves 2, 11 are in contact with the base circle area of the cams 12, 12'. Accordingly, the rocker arms 14, 14' are moved at a stretch toward the side of the cams 13, 13' for cylinder rest or deactivation so as to be brought into contact or engagement with the cams 13, 13', respectively. Then, in the No. 3 cylinder, the usual lift of the exhaust valve 2 has been initiated, and at least one of the intake and exhaust valves 2, 11 is driven through the rocker arms 14, 14' by the cams 12, 12' until the termination of the succeeding lift of the intake valve 2, so that the rocker arms 14, 14' cannot move axially due to a higher frictional force caused by the load of the valve spring. However, at the time point at which the usual lift of the intake valve 2 has been terminated, the rocker arms 14, 14' move at a stretch to be brought into contact or engagement with the cams 13, 13', respectively, thus completing the valve operation changing of the cylinders which are capable of being deactivated or at rest in accordance with the engine operating condition.

Thus, it is preferable that the timing lifter 25 operates to project the rod 25C at the time point at which the usual lift of the intake valve 2 of either one of the cylinders capable of being deactivated in accordance with the engine operating condition is terminated. This becomes possible to obtain the maximum time from the valve operation changing time to the time point at which the next valve lift of the exhaust valve 11 is initiated.

It will be seen that the magnitude relationship between the two oil pressures applied to the pilot valve 24 is reversed when the flow direction changing valve 23 is shifted, and therefore the signal oil pressures from the pilot valve 24 act on the flow direction changing valve 23 in such a manner as to restore the flow direction changing valve 23 to the initial state. However, the flow direction changing valve 23 is not shifted in practice at this moment since the flow direction changing valve spool 23C has been locked, standing ready for the forthcoming shifting of the flow direction changing valve 23. Thus, since the signal oil pressures applied to the flow direction changing valve 23 has been already changed, the flow direction changing valve spool 23C is shifted at a stretch when the stopper 26 is released for the valve operation changing, thereby improving the response of operation.

According to the valve operation changing system of FIG. 20, the hydraulic clutch is used to accomplish the intermission of a transmission line from the timing lifter (as a releasing device for the stopper) to the stopper. This hydraulic clutch receives the actuator oil pressures which are varied by the flow direction changing valve shifting and supplied through the electromagnetic flow direction shifting valve, thereby providing a feedback control characteristics that the hydraulic clutch can be smoothly disengaged by the variation of the actuator oil pressures after the shifting of the flow direction changing valve upon clutch engagement. As a result, when the hydraulic clutch has been engaged, the clutch is automatically disengaged after the shifting of the flow direction changing valve spool and immediately after the clutch engagement. This makes the minimum the time necessary for clutch engagement, avoiding failed operation of the valve operation changing system. Besides, the electromagnetic flow direction shifting valve is allowed to remain as it is after its shifting, and therefore it is sufficient to operate the flow direction shifting valve in an ON-OFF manner in accordance with engine operation conditions, thus simplifying an circuit arrangement as compared with in case of using a pulse-controlled electromagnetic clutch.

While the cam 12 (12'), including narrower cams 12A, 12B (12A', 12B'), and the cam 13 (13') have been shown and described as being used for activating and for deactivating cylinder, respectively, in the system of the embodiments of FIGS. 7–9, 11–14, 20 and 21 it will be understood that the cam 12 (12') and the cam 13 (13') may be, for example, used for a high engine speed operation and for a low engine speed operation, respectively, as in the system of the embodiment of FIG. 16 and 18. In accordance with the cam for the high engine speed operation, the valve overlap of intake and exhaust valves will be increased thereby to improve the charging efficiency of intake air at a high engine speed operating range. In accordance with the cam for the low engine speed operation, the valve overlap will be decreased to prevent exhaust gas backward flow to the cylinder in the state where a throttle valve opening degree is smaller, thereby improving the charging efficiency of intake air even at a low engine speed operating range.

It will be clearly understood from the above, that such a cam arrangement shown in FIGS. 7–9, 11–14, 20 and 21 is applicable to a variety of engines other than dual-mode engines in which some of cylinders are deactivated in accordance with engine operating conditions.

Although the stopper 26 has been shown and described as restricting the operation of the flow direction changing valve in the majority of the above-discussed embodiments, it will be appreciated that the stopper or corresponding means may be arranged to directly restrict the movement of the rocker arms or to directly restrict the operation of the actuator having the hydraulic pressure chambers 19A, 19B, **50*a*, 51*a***.

Having described the present invention as related to the embodiments shown in the accompanying drawings, it is intended that the invention be not limited by any of the details of description, unless otherwise specified, but rather be constructed broadly within its spirit and scope as set out in the accompanying claims.

What is claimed is:

1. A valve operation changing system of an internal combustion engine, comprising:

first and second cams (12, 13; 45A, 45B) formed on a camshaft (6) and different in cam profile from each other;

a rocker arm (3, 3') mounted on a rocker shaft and swingable around the rocker shaft to operate an engine valve (2, 11) upon engagement with said cams, said rocker arm (3, 3') being axially movable to engage with said first cam (12, 45A) when said rocker arm is put in a first position while with said second cam (13, 45B) when said rocker arm is put in a second position; and means (21, 22, 23, 19A, 19B, 24, 25, 26) for selectively putting said rocker arm in one of said first and second positions in accordance with an engine operating condition, said putting means including an oil pressure source (21) for supplying pressurized hydraulic oil, a flow direction changing valve (23) fluidly connected to said oil pressure source and arranged to selectively take one of its first and second states, means defining first and second hydraulic pressure chambers (19A, 19B; 50*a*, 51*a*) which are fluidly connectable with said oil pressure source through said flow direction changing valve, said first hydraulic pressure chamber (19A; 50*a*) being suppliable with the oil fed through said flow direction changing valve so as to put said rocker arm into the first position when said flow direction changing valve is in the first state, said second hydraulic pressure chamber (19B; 51*a*) being suppliable with the oil fed through said flow direction changing valve so as to put said rocker arm into the second position when said flow direction changing valve is in the second state, stopper means (26) controlling position of said flow direction changing valve to restrict the axial movement of said rocker arm; and means (25) for releasing said flow direction changing valve from position control of said stopper means in timed relation to the rotation of said first and second cams when actuated, whereby the movement of said rocker arm between the first and second positions takes place in timed relation to the rotation of said first and second cams.

2. A valve operation changing system as claimed in claim 1, wherein said oil pressure source includes an oil pump (21) driven in timed relation to the revolution of the engine to pressurize the hydraulic oil.

3. A valve operation changing system as claimed in claim 2, wherein said oil pump has (21) a pump piston (21A) which is reciprocally movable in timed relation to the engine revolution to provide oil pressure.

4. A valve operation changing system claimed in claim 2, further comprising an oil accumulator (22) fluidly interposed between said oil pump and said flow direction changing valve to accumulate the pressurized oil from said oil pump.

5. A valve operation changing system as claimed in claim 4, further comprising means (24) for selectively putting said flow direction changing valve into one of the first and second states in accordance with the engine operating condition.

6. A valve operation changing system as claimed in claim 5, wherein said stopper means (26) is arranged when actuated to restrict said flow direction changing valve from changing position; and said releasing means (25) is arranged to release said flow direction changing valve from the restriction action of said stopper means.

7. A valve operation changing system as claimed in claim 1, wherein said stopper means (26) includes means for restricting the movement of said rocker arm.

8. A valve operation changing system as claimed in claim 1, wherein said stopper means (26) includes means for restricting the operation of an actuator for moving said rocker arm, said first and second hydraulic pressure chambers (19A, 19B; 50*a*, 51*a*) forming part of said actuator.

9. A valve operation changing system as claimed in claim 6, wherein said flow direction changing valve (23) includes a movable valve member (23C) which is locatable to its first and second positions corresponding respectively to the first and second states of said flow direction changing valve.

10. A valve operation changing system as claimed in claim 9, wherein said flow direction changing valve putting means includes a pilot valve (24) which takes its first and second states for causing said flow direction changing valve movable valve member to be located into the first and second positions, respectively.

11. A valve operation changing system as claimed in claim 10, wherein said oil pump (21) includes a piston (21A) which is reciprocally movable in timed relation to a drive cam (20) formed on said camshaft (6) on which said first and second cams (12, 13; 45A, 45B) are formed, the reciprocal motion of said piston pressurizing the oil.

12. A valve operation changing system as claimed in claim 11, wherein said stopper means includes a stopper member (26) which is engageable with said movable valve member (23C) of said flow direction changing valve to stop the movement of said movable valve member.

13. A valve operation changing system as claimed in claim 12, wherein said releasing means includes a timing lifter (25) directly fluidly connected to said oil pump (21) and operated in timed relation to the rotation of said drive cam (20), said timing lifter being arranged to release the engagement of said stopper member (26) with said valve member (23C) of said flow direction changing valve, upon connection with said stopper member (26).

14. A valve operation changing system as claimed in claim 13, further comprising means for moving said valve member (23C) of said flow direction changing valve by the pressure of the oil from said accumulator through said pilot valve (24).

15. A valve operation changing system as claimed in claim 4, wherein said stopper means includes a stopper valve (34) disposed in an oil restoring passage (R) through which said first and second hydraulic pressure chambers (19A, 19B) are communicable with an oil tank (29), said stopper valve (34) being arranged to block said oil restoring passage (R).

16. A valve operating changing system as claimed in claim 15, wherein said releasing means includes a timing lifter (25) directly fluidly connected to said oil pump (21) and operated in timed relation to the rotation of said drive cam (20), said timing lifter being arranged to release the blocking action of said stopper valve (34).

17. A valve operation changing system as claimed in claim 14, further comprising means (30) for selectively putting said pilot valve (24) into one of the first and second states in accordance with the engine operating condition.

18. A valve operation changing system as claimed in claim 14, further comprising means for selectively putting said pilot valve (24) into one of the first and second states in accordance with a difference between pressures in connection with first and second hydraulic pressure chambers, respectively (19A, 19B), respectively.

19. A valve operation changing system as claimed in claim 18, wherein the connection of said timing lifter (25) and said stopper member (26) is capable of being interrupted, said system further comprising means for providing the connection of said timing lifter (25) and said stopper member (26) only in response to a predetermined engine operating condition in which the shifting of said rocker arm (3) between the first and second positions is necessary.

20. A valve operation changing system as claimed in claim 19, wherein said providing means includes clutch means (59) operatively interposed between said timing lifter (25) and said stopper member (26) to establish the connection between said timing lifter and said stopper member when engaged, and control means (30, 61) for causing said clutch means to be engaged in response to the predetermined engine operating condition.

21. A valve operation changing system as claimed in claim 20, wherein said clutch means includes a hydraulically operated clutch (59) operated to be engaged or disengaged in accordance with a pressure in connection with said first and second hydraulic pressure chambers.

22. A valve operation changing system as claimed in claim 21, wherein said control means includes valve means (61) for controlling said pressure to cause said hydraulically operated clutch (59) to be engaged or disengaged in response to the predetermined engine operating condition.

23. A valve operation changing system as claimed in claim 22, wherein said hydraulically operated clutch (59) includes a piston member (56) defining oppositely disposed first and second hydraulic chambers (57, 58) which are respectively suppliable with a first pressure (A1) in connection with said first hydraulic pressure chamber (19A) and a second pressure (B1) in connection with said second hydraulic pressure chamber (19B), said piston member (56) being axially movable in response to a difference between said first and second pressures (A1, B1), and a connecting member (40) secured to said piston member (56) and movable to take a first position at which the connection between said timing lifter (25) and said stopper member (26) is capable of being established while a second position at which the connection between said timing lifter and said stopper member is interrupted.

24. A valve operation changing system as claimed in claim 23, wherein said valve means includes a flow direction shifting valve (61) which is shiftable to reverse the first and second pressures to be supplied to said first and second hydraulic chambers (57, 58) of said hydraulically operated clutch (59) in response to the predetermined engine operating condition.

25. A valve operation changing system as claimed in claim 1, wherein at least one of said cams (12, 13; 12', 13') has a plurality of narrower cams (12A, 12B; 12A', 12B') which are separate from each other.

26. A valve operation changing system as claimed in claim 25, wherein said rocker arm (3, 3') is formed with a follower section (14, 14') having a plurality of contact faces (14B, 14B') at least one of which is contactable with the cam face of said first cam (12, 12') when said rocker arm (3, 3') is put in the first position while with the cam face of said second cam (13, 13') when said rocker arm is put in the second position.

27. A valve operation changing system as claimed in claim 26, wherein said first cam (12, 12') has a cam profile suitable for a first valve timing of the engine valve, and said second cam (13, 13') has a cam profile suitable for a second valve timing of said engine valve, the first valve timing being different from the second valve timing.

28. A valve operation changing system as claimed in claim 27, wherein said plurality of narrower cams (12A, 12B; 12A', 12B') are the same in cam profile.

29. A valve operation changing system as claimed in claim 28, wherein one of narrower cams cam faces (12A, 12B; 12A', 12B') of said first cam (12, 12') and the narrower cams of said second cam (13, 13') are located side by side.

30. A valve operation changing system as claimed in claim 1, further comprising third and fourth cams (47A, 47B) formed on the camshaft (6) and different in cam profile from each other, and an additional rocker arm (3) mounted on the rocker shaft and swingable around the rocker shaft to operate an additional engine valve (2') upon engagement with said third and fourth cams, said engine valve (2) and said additional engine valve (2') being respectively for first and second cylinders whose firing orders are sequential, said additional engine valve (2') being the same in function as in said engine valve (2) and axially movable to engage with said third cam (47A) when said additional rocker arm (3) is put in a first position while with said fourth cam (47B) when said additional rocker arm is put in a second position, in which said putting means includes means (49) by which said rocker arm and said additional rocker arm are simultaneously axially movable between their first and second positions, and means (21, 22, 23, 24, 25, 26, 51, 52) for moving said rocker arm and said additional rocker arm at a predetermined timing in crank angle.

31. A valve operation changing system as claimed in claim 1, wherein said selectively putting means includes control means for selectively putting said flow direction changing valve into one of the first and second states in accordance with the engine operating condition.

32. A valve operation changing system as claimed in claim 31, wherein said stopper means is constructed and arranged to prevent said flow direction changing valve from changing in function relative to said first and second hydraulic pressure chambers, when actuated.

33. A valve operation changing system as claimed in claim 32, wherein said releasing means is constructed and arranged to release the actuation of said stopper means in timed relation to the rotation of said first and second cams, when actuated, whereby said flow direction changing valve is changeable in function relative to the first and second hydraulic pressure chambers in response to the engine operating condition.

* * * * *